US009541079B2

(12) United States Patent
Ono et al.

(10) Patent No.: US 9,541,079 B2
(45) Date of Patent: Jan. 10, 2017

(54) SEALED COMPRESSOR

(75) Inventors: Kazuhiko Ono, Shiga (JP); Yasushi Hayashi, Shiga (JP); Makoto Katayama, Shiga (JP); Kazuhiro Yokota, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 779 days.

(21) Appl. No.: 13/443,563

(22) Filed: Apr. 10, 2012

(65) Prior Publication Data

US 2012/0257993 A1 Oct. 11, 2012

(30) Foreign Application Priority Data

Apr. 11, 2011 (JP) ..... 2011-087020
Jun. 13, 2011 (JP) ..... 2011-130866
(Continued)

(51) Int. Cl.
*F04B 39/00* (2006.01)
*F04C 29/06* (2006.01)
*F04D 29/66* (2006.01)

(52) U.S. Cl.
CPC ..... *F04B 39/0061* (2013.01); *F04B 39/0027* (2013.01); *F04C 29/06* (2013.01);
(Continued)

(58) Field of Classification Search
CPC ..... F04B 39/0061; F04B 39/0027; F04B 39/0033; F04B 39/0038; F04B 39/0044; F04B 39/005; F04B 39/0055; F04B 39/0066; F04C 29/06; F04C 29/061; F04C 29/063; F04C 29/065; F04C 29/066; F04C 29/068; F04D 29/663; F04D 29/664
(Continued)

(56) References Cited

U.S. PATENT DOCUMENTS 4,370,104 A * 1/1983 Nelson ..... F04B 39/0027 181/403
4,755,108 A * 7/1988 Todescat ..... F04B 39/0055 181/403
(Continued)

FOREIGN PATENT DOCUMENTS

CN 1914421 2/2007
CN 2893214 Y 4/2007
(Continued)

OTHER PUBLICATIONS

Chinese Office Action, May 26, 2015; Chinese Patent Application No. 201210105450.8, with English translation of its Search Report (16 pages).
(Continued)

*Primary Examiner* — Dominick L Plakkoottam
(74) *Attorney, Agent, or Firm* — Hamre, Schumann, Mueller & Larson, P.C.

(57) ABSTRACT

A sealed compressor according to the present invention comprises an electric element; a compression element; a sealed container; and a suction pipe. The compression element includes a compression chamber, a piston provided inside of the compression chamber, and a suction muffler communicating with the inside of the sealed container and the compression chamber. The suction muffler is laid out such that an opening portion thereof at the sealed container side faces an opening portion of the suction pipe at the sealed container side. The suction muffler includes: a hood section provided in the vicinity of the opening portion of the suction muffler to extend toward the inside of the sealed container, the hood section being configured to collect cooling medium gas discharged from the suction pipe; and an auxiliary hood fastened to the hood section and formed in a manner to increase a collection area of the hood section.

18 Claims, 21 Drawing Sheets

(30) Foreign Application Priority Data

Jun. 13, 2011 (JP) ..... 2011-130872
Mar. 19, 2012 (JP) ..... 2012-061474

(52) U.S. Cl.
CPC ..... *F04C 29/065* (2013.01); *F04C 29/068* (2013.01); *F04D 29/663* (2013.01)

(58) Field of Classification Search
USPC ..... 417/312, 902; 181/403
See application file for complete search history.

(56) References Cited

U.S. PATENT DOCUMENTS 4,793,775 A * 12/1988 Peruzzi ..... F04B 39/0055 417/312
5,228,843 A * 7/1993 Novolan ..... F04B 39/0072 184/6.18
5,252,035 A * 10/1993 Lee ..... F04B 39/0044 181/403
5,322,419 A * 6/1994 Novolan ..... F04B 39/0072 184/6.18
5,451,727 A * 9/1995 Park ..... F04B 39/0044 181/229
6,155,800 A * 12/2000 Todescat ..... F04B 39/123 181/403
6,305,912 B1 * 10/2001 Svendsen ..... F04B 39/0072 29/888.02
2002/0034450 A1 3/2002 Svendsen et al.
2004/0120832 A1 * 6/2004 Nishihara ..... F04B 39/023 417/312
2007/0154330 A1 7/2007 Freiberger
2007/0212234 A1 9/2007 Murata
2008/0008603 A1 1/2008 Schoegler
2008/0219863 A1 * 9/2008 Jung ..... F04B 39/0061 417/312
2008/0267792 A1 * 10/2008 Yokota ..... F04B 39/0061 417/312
2013/0129537 A1 * 5/2013 Kawabata ..... F04C 13/001 417/410.1

FOREIGN PATENT DOCUMENTS

| | | | |
|---|---|---|---|
| JP | 55-130081 | U | 9/1980 |
| JP | S58-6973 | U | 1/1983 |
| JP | 62-130186 | U | 8/1987 |
| JP | S63-500878 | | 3/1988 |
| JP | 2003-42064 | | 2/2003 |
| JP | 2006-161705 | | 6/2006 |
| JP | 2008-215194 | | 9/2008 |
| JP | 2010-84677 | | 4/2010 |
| KR | 20030043014 | | 6/2003 |
| KR | 20030043016 | | 6/2003 |
| KR | 20060087901 | | 8/2006 |

OTHER PUBLICATIONS

Office Action issued in corresponding Japanese Patent Application No. 2012-061474, Oct. 6, 2015, 2 pages.

* cited by examiner

SEALED COMPRESSOR

BACKGROUND OF THE INVENTION

Field of the Invention

The present invention generally relates to a sealed compressor for use in an electric refrigerator-freezer for household use, a showcase, or the like. More particularly, the present invention relates to a suction muffler of the sealed compressor.

Description of the Related Art

In recent years, there has been an increasing demand for global environment conservation. In particular, there has been a strong demand for higher efficiency in refrigerators, other refrigeration cycle devices, or the like.

As a conventional sealed compressor of this type, there are known a configuration in which a suction pipe communicating inside and outside of a sealed container and a suction inlet of a suction muffler of a compressor communicate with each other by means of an auxiliary hood made of a flexible material (see e.g., Japanese Unexamined Patent Application Publication No. Sho. 63-500878)), and a configuration in which a suction pipe communicating inside and outside of a sealed container and a suction inlet of a suction muffler of a compressor are arranged to face each other (see e.g., Japanese Laid-Open Patent Application Publication No. 2010-084677).

Now, the above stated conventional sealed compressors will be described with reference to the drawings.

FIG. 18 is a longitudinal sectional view of the conventional sealed compressor disclosed in Japanese Unexamined Patent Application Publication No. Sho. 63-500878. FIG. 19 is a cross-sectional view of the sealed compressor of FIG. 18. FIG. 20 is an enlarged view of major components of the sealed compressor of FIG. 18.

Referring to FIGS. 18 to 20, this sealed compressor reserves refrigerator oil 3 in a bottom portion of a sealed container 1 and is filled with cooling medium gas 5. The sealed compressor has a compressor body 7 elastically supported on the sealed container 1 by a suspension spring 9.

The compressor body 7 includes an electric (electrically driven) element 11 and a compression element 13 positioned above the electric element 11. The electric element 11 includes a stator 15 and a rotor 17.

The compression element 13 includes a crankshaft 23 having a main shaft 21 and an eccentric shaft 19 which are secured to the rotor 17, a block 29 provided integrally with a cylinder 27 forming a compression chamber 25, a piston 31 which is slidable inside the cylinder 27, a valve plate 33 for closing the end surface of the cylinder 27, a suction valve (not shown) for opening and closing a suction hole (not shown) provided on the valve plate 33, and a coupling member 35 for coupling the eccentric shaft 19 to the piston 31.

A suction muffler 39 is retained and fastened by the valve plate 33 attached to the end surface of the cylinder 27 and a cylinder head 37 for closing the valve plate 33.

The suction muffler 39 includes a muffler body 41 forming a muffling space and molded using resin such as PBT (polybuthylene terephthalate), PP (polypropylene), or PPS (polyphenylene sulfide), an opening portion 43 provided on the muffler body 41, and a hood 45 made of a flexible material.

One end of the hood 45 is elastically secured to the opening portion 43 of the muffler body 41 only by its own elasticity, and the other end thereof is pressed to elastically contact the inner wall surface of the sealed container 1 and enclosing an opening portion of a suction pipe 47 inside the container 1. The suction pipe 47 is attached on the sealed container 1 to provide communication between inside and outside of the container 1.

FIG. 21 is an enlarged view of major components of the sealed compressor disclosed in Japanese Laid-Open Patent Application Publication No. 2010-084677.

Referring to FIG. 21, a suction muffler 50 includes a muffler body 55 forming a muffling space and molded using resin such as PBT, PPS, or LCP (liquid crystal polymer), an opening portion 51 provided on the muffler body 55, and a suction hood 52 made of a flexible material.

One end of the suction hood 52 is elastically secured to the opening portion 51 of the muffler body 51 only by its elasticity, and the other end thereof is disposed with a gap from the inner wall surface of a sealed container 54 such that the other end faces an opening portion of a suction pipe 53 inside the sealed container 54. The suction pipe 53 is attached on the sealed container 54 to provide communication between inside and outside of the sealed container 54.

The operation of each of the above configured conventional sealed compressors will now be described.

In the sealed compressor, a current is supplied to the stator 15 to generate a magnetic field, and thereby the rotor 17 secured to the main shaft 21 is rotated, which causes the crankshaft 23 to be rotated. The piston 31 reciprocatingly slides inside the cylinder 27 via the coupling member 35 rotatably attached to the eccentric shaft 19.

By the reciprocation movement of the piston 31, the cooling medium gas 5 is suctioned into and compressed in a compression chamber 25, and is discharged into the refrigeration cycle (not shown), which operation occurs repeatedly.

The cooling medium gas 5 supplied from the refrigeration cycle (not shown) in a suction step flows through the suction pipe 47, the hood 45, and then the suction muffler 39, and is introduced into the compression chamber 25 through a suction hole (not shown) communicating with the compression chamber 25 by opening a suction valve (not shown).

The suction muffler 39 is capable of reducing a noise generated by the intermittent suction of the cooling medium gas 5. In addition, the suction muffler 39 is made of the resin having a low heat conductivity, which suppresses the cooling medium gas 5 flowing through the suction muffler 39 from being heated.

However, in the sealed compressor disclosed in Japanese Unexamined Patent Application Publication No. Sho. 63-500878, the hood 45 and a fitting portion of the opening portion 43 of the suction muffler 39 are made of materials with different linear expansion coefficients. Therefore, strict dimension accuracy is required in a mounting portion (not shown) of the hood 45 and the fitting portion. In addition, typically, rubber is used as the flexible material forming the hood 45. Since the hood 45 is exposed all the time to the cooling medium gas 5 and the refrigerator oil 3 under a high temperature condition, the rubber swells or is deformed, and cannot maintain its original shape. This makes a fitting state unstable.

As another fastening structure, it can be easily conceived that the hood 45 is fastened to the opening portion 43, for example, by tightening the hood 45 to the opening portion 43 by an elastic spring member, or the like. This increases components in number, and makes an assembling work very difficult.

In the structure for connecting the hood 52 and the opening portion 51 together in the scaled compressor disclosed in Japanese Laid-Open Patent Application Publication No. 2010-084677, as shown in FIG. 21, there is a distance between the suction pipe 53 and the hood 52. Therefore, it is possible to prevent the cooling medium gas or the like discharged from the suction pipe 53 from being directly suctioned into the suction muffler 50. However, because of a small area of the hood 52, the cooling medium gas discharged from the suction pipe 53 cannot be suctioned into the suction muffler 50 efficiently, and a part of the cooling medium gas leaks into the sealed container 54 at a connecting portion.

SUMMARY OF THE INVENTION

The present invention is directed to solving the above stated problem associated with the prior art, and an object of the present invention is to provide a sealed compressor which provides high efficiency, stable performance and high reliability.

According to the present invention, a sealed compressor comprises an electric element; a compression element driven by the electric element; a sealed container accommodating the electric element and the compression element; and a suction pipe attached on the sealed container to provide communication between inside and outside of the sealed container; wherein the compression element includes a compression chamber, a piston provided inside of the compression chamber, and a suction muffler made of a resin material which is fusible and communicating with the inside of the sealed container and the compression chamber; the suction muffler is laid out such that an opening portion thereof at the sealed container side faces an opening portion of the suction pipe at the sealed container side; and the suction muffler includes a hood section provided in the vicinity of the opening portion of the suction muffler to extend toward inside of the sealed container, the hood section being configured to collect cooling medium gas discharged from the suction pipe; and an auxiliary hood fastened to the hood section and extending toward the inside of the sealed container to a greater degree than the hood section to increase an area of the hood section which can collect the cooling medium gas, the auxiliary hood being made of a flexible material.

In accordance with this configuration, the suction muffler can effectively collect the cooling medium gas discharged into the sealed container and suction it by using the auxiliary hood. Since the auxiliary hood is made of the flexible material, damage to the auxiliary hood is prevented if it collides against the inner wall of the sealed container. As a result, the hood section of the suction muffler and the scaled container can be laid out with a small gap (space) between them, and the cooling medium gas discharged into the sealed container can be collected more effectively, which results in a higher efficiency of the compressor.

In addition, since the opening portion of the suction muffler opens inside of the sealed container, a pulsative component of the cooling medium gas in a low frequency range which has not been attenuated sufficiently in the suction muffler can be released into the sealed container through the opening portion and attenuated. As a result, a pipe vibration in a cooling system can be mitigated, durability of the system can be improved, and a noise can be mitigated.

In the sealed compressor of the present invention, the hood section may be provided with a first projection of a pin shape; the auxiliary hood may have a first through-hole; and the hood section and the auxiliary hood may be fastened together in a state where the first projection is inserted into the first through-hole and a tip end portion of the first projection is deformed.

In accordance with this configuration, the auxiliary hood is fastened to the hood section by fusing (melting) the first projection. Since the components are not increased in number, the sealed compressor can be manufactured inexpensively.

In the sealed compressor of the present invention, the suction muffler may have a rectangular side wall having long sides and short sides, and the side wall has the opening portion; and the hood section may be provided on the side wall and has a circular-arc shape when viewed from a direction in which the hood section extends.

In accordance with this configuration, since the auxiliary hood extends in the circular-arc shape toward inside of the sealed container, the cooling medium gas discharged from the suction pipe can be guided smoothly to the opening portion of the hood section. As a result, most of the cooling medium gas released from the suction pipe is not diffused in the interior of the sealed container but is supplied to the interior of the compression chamber. Therefore, the high-temperature cooling medium gas in the interior of the sealed container, which is suctioned into the suction muffler, can be lessened to a minimum amount. As a result, the sealed compressor can achieve high efficiency and stabilize its performance.

The sealed compressor of the present invention may further comprise a binder having a through-hole; and the hood section, the auxiliary hood, and the binder may be joined together in this order; and the hood section, the auxiliary hood, and the binder may be fastened together in a state where the first projection is inserted into the first through-hole of the auxiliary hood and into the through-hole of the binder, and a tip end portion of the first projection is deformed.

In accordance with this configuration, the auxiliary hood and the hood section can be adhesively attached together more firmly, and deformation of the auxiliary hood made of the flexible material can be suppressed. As a result, it is possible to avoid a situation in which the auxiliary hood is deformed by the pressure of the cooling medium gas discharged from the suction pipe and thereby the cooling medium gas is not collected effectively by the auxiliary hood. Since the cooling medium gas can be collected stably, performance of the sealed compressor can be stabilized.

In the sealed compressor of the present invention, the binder and the first projection of the hood section may be made of the same material.

In accordance with this configuration, the auxiliary hood is fastened to the binder by fusing (melting) the first projection. In addition, since the binder and the first projection are made of the same material, the binder and the first projection can be fastened together more firmly. As a result, performance of the sealed compressor can be maintained with higher reliability.

In the sealed compressor of the present invention, the auxiliary hood may have a press section for receiving a pressure of the cooling medium gas discharged from the suction pipe.

In accordance with this configuration, even when a contact state between the hood section and the auxiliary hood is degraded, it is possible to suppress the auxiliary hood from being displaced from the hood section in an upward direction due to the pressure of the cooling medium gas. Therefore, it is possible to suppress the auxiliary hood from being disengaged from the hood section. Thus, reliability of the sealed compressor can be maintained for a long period.

In the sealed compressor of the present invention, the auxiliary hood may have a circular-arc portion having a circular-arc shape; the press section may include a connecting portion connecting both ends of the circular-arc portions together, at least a portion of the connecting portion being configured to contact the side wall of the suction muffler; and a cover portion provided on the connecting portion and configured to contact a front side wall adjacent to the side wall of the suction muffler.

In accordance with this configuration, the cover portion contacts the front side wall of the suction muffler, and formation of a clearance between the connecting portion and the side wall of the suction muffler with which the connecting portion contacts is suppressed. This makes it possible to suppress the connecting portion of the auxiliary hood from being displaced in an upward direction. Therefore, it is possible to prevent the auxiliary hood from being disengaged from the hood section with higher reliability and to hence suppress the cooling medium gas from being diffused in the interior of the sealed container due to the upward displacement with higher reliability. As a result, reliability of the sealed compressor can be further improved.

The sealed compressor of the present invention may further comprise a second projection of a pin shape provided on the front side wall of the suction muffler which contacts the cover portion of the auxiliary hood; wherein the cover portion of the auxiliary hood may have a second through-hole into which the second projection is fitted.

In accordance with this configuration, it is possible to suppress the cover portion of the auxiliary hood from being separated from the front wall surface of the suction muffler. Therefore, even when the auxiliary hood swells or is deformed because of the fact that the auxiliary hood is always exposed to high-temperature cooling medium gas and refrigerator oil, it is possible to more surely prevent a clearance from being generated between the auxiliary hood and the wall surface of suction muffler, and more surely prevent the auxiliary hood from being disengaged from the hood section. As a result, efficiency of the sealed compressor can be maintained stably.

In the sealed compressor of the present invention, the front side wall of the suction muffler which contacts the cover portion of the auxiliary hood may have a recess to accommodate the cover portion.

In accordance with this configuration, the projection of the pin shape for fastening the cover portion is provided on the recess. This makes it possible to fasten the cover portion of the auxiliary hood by using the projection and lessen an area of a portion of the auxiliary hood from protruding from the wall surface of the suction muffler. Thereby, if the compression element vibrates during transportation, start-up, and shut-down, of the compressor, it is possible to avoid a situation in which the projection of the pin shape provided on the front wall of the suction muffler from contacting the inner wall of the sealed container, and hence prevent damage to the suction muffler.

In the sealed compressor of the present invention, the opening portion of the suction pipe at the sealed container side may be positioned between a base end portion of the hood section and a tip end portion of the auxiliary hood in the suction muffler.

In accordance with this configuration, most of the cooling medium gas released from the suction pipe is not diffused in the interior of the sealed container but is supplied to the interior of the high-temperature compression chamber. Therefore, the high-temperature cooling medium gas in the interior of the sealed container, which is suctioned into the suction muffler, can be lessened to a minimum amount. And, since the opening portion of the suction pipe is made closer to a lowest-temperature portion in the interior of the sealed container, a temperature increase in the cooling medium gas can be lessened to a minimum level. As a result, the sealed compressor can achieve higher efficiency and stabilize its performance.

In the sealed compressor of the present invention, a cross-section of the hood section in a direction perpendicular to a direction in which the hood section extends may be geometrically similar to a cross-section of the auxiliary hood in a direction perpendicular to a direction in which the auxiliary hood extends.

In accordance with this configuration, in the portion where the hood section and the auxiliary hood are connected together, they are adhesively attached together more firmly. Therefore, it is possible to prevent the auxiliary hood from being disengaged from the hood section with higher reliability and to hence suppress the cooling medium gas from being diffused in the interior of the sealed container due to the upward displacement with higher reliability. As a result, reliability of the sealed compressor can be further improved. In addition, since the cross-sectional shapes of the hood section and of the auxiliary hood are geometrically similar, the flow of the cooling medium gas from the auxiliary hood to the hood section is not obstructed by an abrupt change in the shape, or the like, but can be guided into the suction muffler more efficiently.

In the sealed compressor of the present invention, the suction muffler may include a body forming a muffling space; an inlet pipe having an upstream end forming the opening portion of the suction muffler at the sealed container side and a downstream end which opens in the muffling space; an outlet pipe having an upstream end which opens in the muffling space; a downstream end communicating with the compression chamber; and a bent portion between the upstream end and the downstream end in the muffling space, a portion of the outlet pipe which is upstream of the bent portion being inclined in a downward direction; and an oil discharge hole provided in a bottom portion of the muffling space so as to open in a space inside of the sealed container; wherein the inlet pipe may have a shape in which a horizontal length of an opening portion of the upstream end is smaller than a horizontal length of the opening portion of the suction pipe, and a vertical length of the opening portion of the upstream end is greater than a vertical length of the opening portion of the suction pipe.

In accordance with this configuration, the outlet pipe can be inclined such that its opening end is oriented in the downward direction within the muffling space. This makes it possible to reduce a vertical dimension of the suction muffler while ensuring the overall length of the outlet pipe. Therefore, it is possible to prevent the size of the suction muffler from being increased unnecessarily. In addition, since the portion of the outlet pipe which is upstream of the bent portion is inclined in the downward direction, a liquid with a high specific gravity such as a great quantity of oil or a liquid cooling medium can drop by its own weight, even when they flow into the muffling space. As a result, it is possible to suppress the liquid with a high specific gravity from being introduced into the compression chamber and hence suppress degradation of a refrigeration ability of the sealed compressor which would otherwise be caused by the introduction of the liquid, or an increase in a noise or a vibration generated in the sealed compressor, and further to suppress degradation of performance of a heat exchanger.

Further, the vertical length of the opening of the inlet pipe at the sealed container side is set greater than the vertical length of the opening of the suction pipe, to ensure a cross-sectional area of the opening of the inlet pipe at the sealed container side, and the horizontal length of the opening of the inlet pipe at the sealed container side is set smaller than the horizontal length of the opening of the suction pipe. This makes it possible to reduce a passage resistance of the cooling medium gas flowing in the inlet pipe while suppressing an unnecessary increase in the size of the suction muffler. If the number of steel plates of the stator is changed depending on a required efficiency of the compressor, the positional relationship between the inlet pipe and the suction pipe can be maintained such that their opening portions are closer to each other and face each other without adjusting the position of the suction pipe, because the opening portion of the inlet pipe at the sealed container side has a sufficient vertical length.

In the sealed compressor of the present invention, the inlet pipe may have a shape in which a vertical length of the inlet pipe is set to 25 to 50% of a vertical length of the muffling space.

In accordance with this configuration, the muffling space having a sufficient volume can cover a reduction of an attenuation ability of a pressure pulsation and a noise at the inlet pipe which would be caused by an increase in the cross-sectional area of the inlet pipe. As a result, it is possible to provide a sealed compressor which is inexpensive, has high reliability and a high efficiency and generates a low noise.

In the sealed compressor of the present invention, the inlet pipe may be molded integrally with the body; and the inlet pipe has a flow passage having a linear shape having no bent portion.

In accordance with this configuration, since the components of the suction muffler can be reduced in number, the suction muffler can be assembled more easily. In addition, since the flow passage of the inlet pipe has a linear (straight-line) shape, the flow passage resistance of the cooling medium gas in the inlet pipe can be reduced. As a result, it is possible to provide a sealed compressor which is easier in assembling and has a high efficiency.

In the sealed compressor of the present invention, a cross-section of the inlet pipe in a direction perpendicular to a direction in which the cooling medium gas flows may have a substantially rectangular shape.

In accordance with this configuration, since the rectangular cross-sectional shape can be made greater in cross-sectional area than a circular cross-sectional shape in a limited volume of the muffling space, it is possible to suppress an increase in the size of the suction muffler.

In general, the suction pipe is made of metal such as copper or iron and has a circular shape. Because of this, if the suction pipe and the inlet pipe are laid out to face each other in a state where the opening portion of the inlet pipe at the sealed container side is displaced with respect to the opening portion of the suction pipe in a vertical direction, the areas of the opening portions of the suction pipe and of the inlet pipe which face each other decrease significantly. However, since the cross-section of the inlet pipe has the rectangular shape, the areas of the opening portions of the suction pipe and of the inlet pipe which face each other will not change significantly even when the opening portion of the inlet pipe at the sealed container side is displaced, as compared to a case where the inlet pipe having the circular cross-sectional shape is used. As a result, a sealed compressor which has a high efficiency and generates a low noise can be provided.

In the sealed compressor of the present invention, the hood section of the suction muffler may be formed of wall portions on at least three sides including a lower wall portion at a lower side of the opening portion of the suction muffler at the sealed container side when viewed from the direction in which the hood section extends, the wall portions enclosing the opening portion; and the lower wall portion may be positioned below a lower end of the opening of the suction pipe at the sealed container side.

Since the cooling medium gas released from the suction pipe into the sealed container has a lower temperature than the cooling medium gas staying in the sealed container, it has a high specific gravity. Therefore, the cooling medium gas flows easily in a downward direction. During the operation of the compression element, the crankshaft rotates by the action of the stator. Therefore, the rotation of the crankshaft acts on the flow of the cooling medium gas in the interior of the sealed container. Because of this, the low-temperature cooling medium gas released from the suction pipe into the sealed container flows in a horizontal direction or a downward direction which is the rotational direction of the crankshaft inside the sealed container. In view of this, in the sealed compressor of the present invention, the wall portions are provided on at least three sides including the lower side of the opening portion of the suction muffler at the sealed container side (i.e., lower side of the upstream end of the inlet pipe), and the lower wall portion is positioned below the lower end of the opening portion of the suction pipe at the sealed container side. This allows the cooling medium gas having a relatively low temperature and flowing in a downward direction to be received by the upper surface (inner surface) of the lower wall portion and to be guided to the inlet pipe with a greater quantity.

The other wall portions (wall portions extending in an upward and downward direction) impedes the horizontal flow of the cooling medium gas in the vicinity of the opening portion of the suction muffler at the sealed container side and suppress diffusion of the cooling medium gas from a space in the vicinity of the opening portion of the suction muffler at the sealed container side. This makes it possible to guide the cooling medium gas having a relatively low temperature to the inlet pipe. As a result, a sealed compressor having a high efficiency can be provided.

In the sealed compressor of the present invention, an opposite end of the outlet pipe may open in the same direction as a direction in which an opposite end of the inlet pipe opens.

In accordance with this configuration, oil flowing into the suction muffler through the inlet pipe can be suppressed from entering the outlet pipe through the opening portion of the outlet pipe at the muffling space side. The oil flowing into the suction muffler through the inlet pipe collides against the outer wall surface of the outlet pipe together with the cooling medium gas. However, since the outlet pipe is inclined in the downward direction, the oil adhering onto the wall surface of the outlet pipe can be moved along the wall surface of the outlet pipe and dropped from its lower end. Thus, the oil can be suppressed from flowing into the outlet pipe.

In the vicinity of the opening portion of the outlet pipe inside the muffling space, the cooling medium gas having a relatively low temperature is supplied intermittently through the inlet pipe. Therefore, the interior of the suction muffler is maintained at a relatively low temperature. Therefore, the cooling medium gas having a relatively low temperature inside the suction muffler can be suctioned selectively through the outlet pipe and can be guided to the compression chamber. Since the opening portion of outlet pipe at the muffling space side opens in the same direction as the direction in which the opening portion of the inlet pipe at the muffling space side opens, the opening portion of the outlet pipe at the muffling space side and the opening portion of the inlet pipe at the muffling space side do not face each other. Therefore, a pressure pulsation generated by the compression operation, a sliding noise generated by the reciprocation movement of the piston, etc., propagate to the inlet pipe gas after they are attenuated though the muffling space, even when they propagate in the direction opposite to the flow of the cooling medium gas. Thus, the pulsation, the noise, etc., are not directly transmitted to the inlet pipe. Therefore, the noise emitted from the sealed container can be mitigated. As a result, a low-noise sealed compressor can be provided.

In the sealed compressor of the present invention, the hood section may have an inner peripheral surface connected smoothly to the inlet pipe through the opening portion of the suction muffler at the sealed container side.

In accordance with this configuration, the shape of the inlet pipe provided inside the suction muffler is not restricted by the shape of the hood section, and an optimal shape of the inlet pipe can be selected to achieve a highest suction efficiency of the cooling medium gas and a highest muffling effect.

The above and further objects and features of the invention will more fully be apparent from the following detailed description with accompanying drawings.

DETAILED DESCRIPTION OF THE PREFERRED EMBODIMENTS

Figure 1:
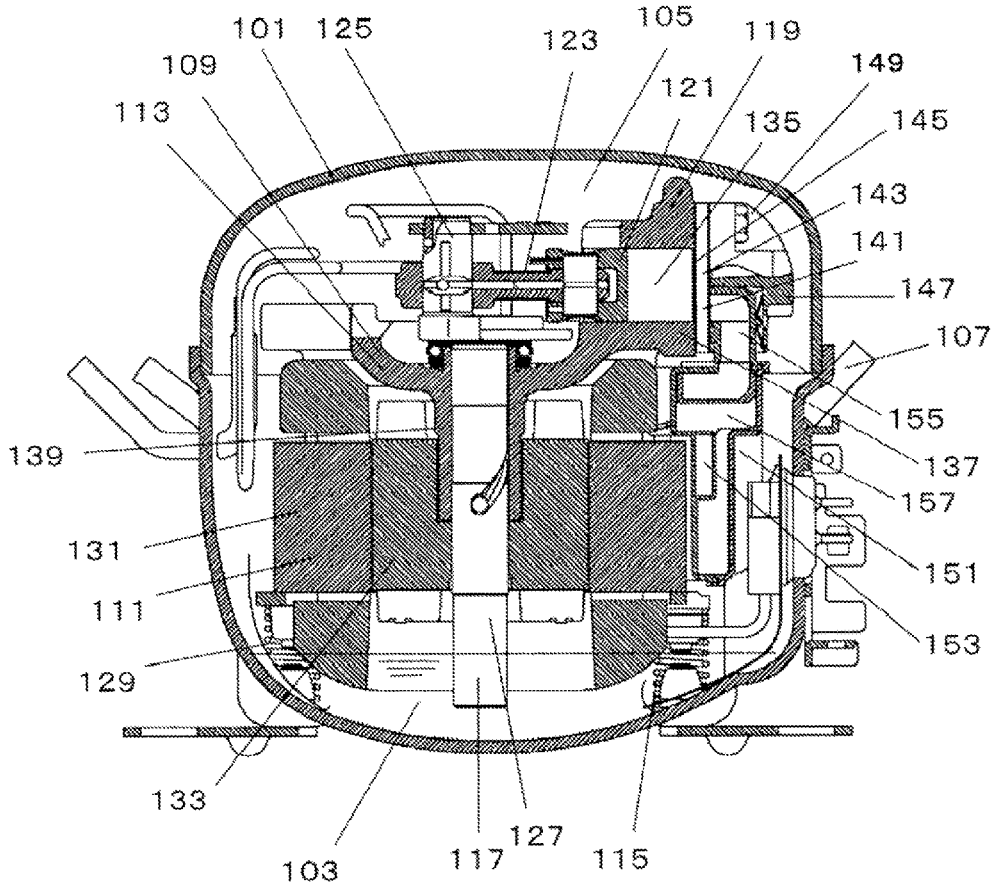
FIG. 1 is a longitudinal sectional view of a sealed compressor according to Embodiment 1 of the present invention.

Hereinafter, preferred embodiments of the present invention will be described with reference to the drawings. Throughout the drawings, the same or corresponding parts are designated by the same reference numerals and repetitive description thereof is sometimes omitted. Throughout the drawings, components required to explain the present invention are extracted and depicted, and other components are omitted. Furthermore, the present invention is in no way limited to the following embodiments in some cases.

(Embodiment 1)

Figure 2:
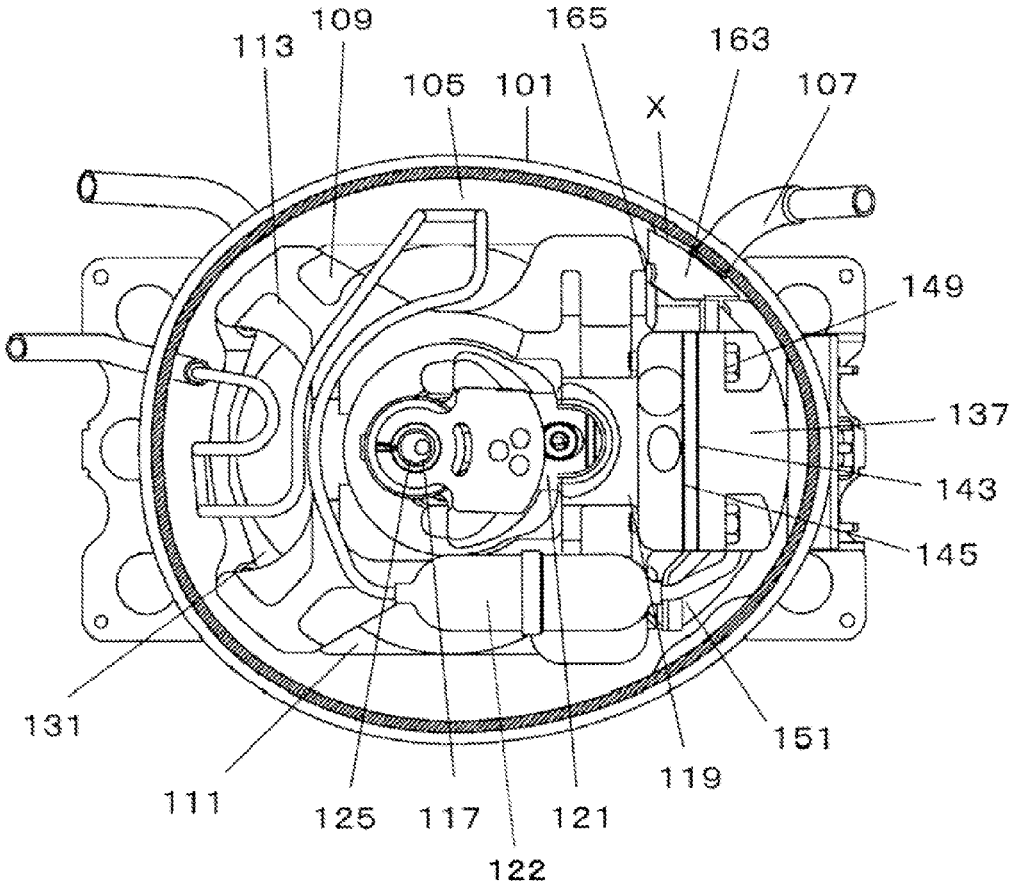
FIG. 2 is a cross-sectional view of the sealed compressor according to Embodiment 1.
Figure 3:
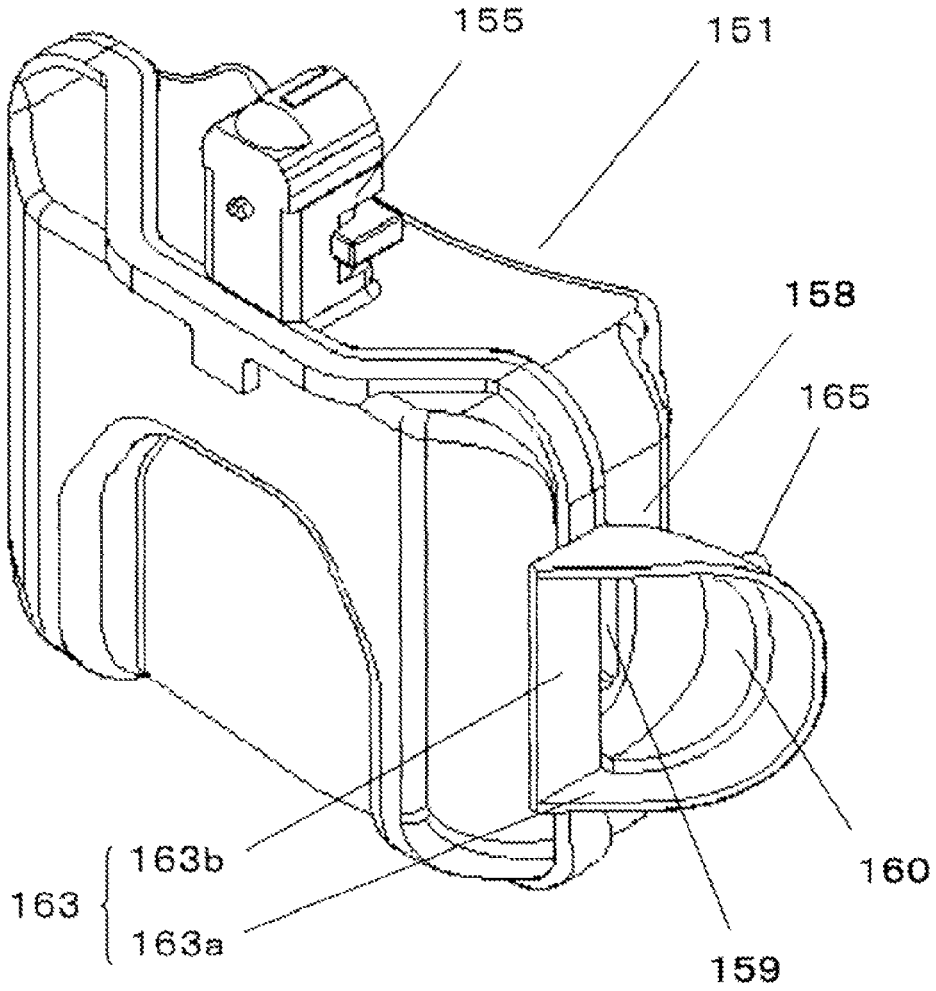
FIG. 3 is a perspective view of a suction muffler of the sealed compressor according to Embodiment 1, when viewed from an outer surface side (sealed container side).
Figure 4:
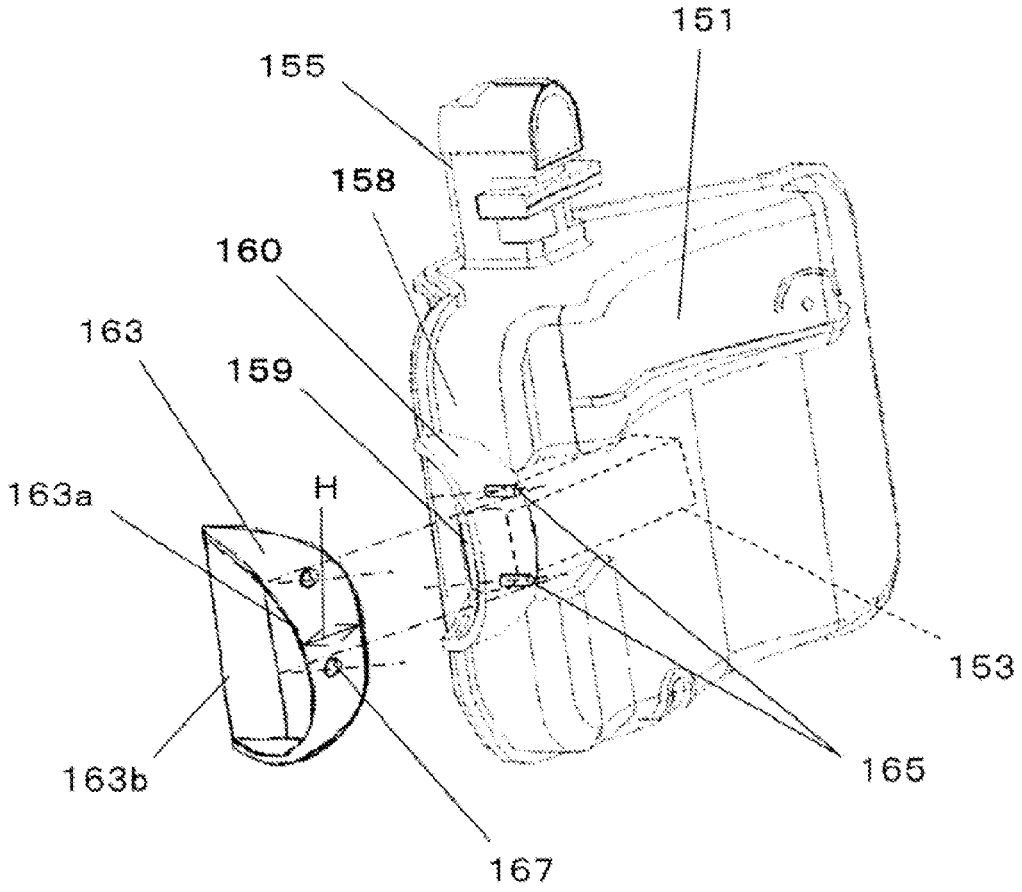
FIG. 4 is an exploded perspective view of the suction muffler of the sealed compressor according to Embodiment 1, when viewed from an inner surface side (electric element side).

FIG. 1 is a longitudinal sectional view of a sealed compressor according to Embodiment 1 of the present invention. FIG. 2 is a cross-sectional view of the sealed compressor according to Embodiment 1. FIG. 3 is a perspective view of a suction muffler of the sealed compressor according to Embodiment 1, when viewed from an outer surface side (sealed container side). FIG. 4 is an exploded perspective view of the suction muffler of the sealed compressor according to Embodiment 1, when viewed from an inner surface side (electric element side).

Referring to FIGS. 1 to 4, the sealed compressor according to Embodiment 1 includes a sealed container 101 which reserves refrigerator oil 103 and is filled with cooling medium gas 105. As an example of the cooling medium gas 105, there is hydrocarbon based R600a having a low global warming potential, etc.

The sealed container 101 is manufactured by drawing of a steel plate. The sealed container 101 is provided with a suction pipe 107, one end of which communicates with the interior of the sealed container 101 and the other end of which is connected to a lower pressure side of a refrigeration cycle (not shown).

The sealed container 101 accommodates a compressor body 113 including an electric (electrically driven) element 111 and a compression element 109 driven by the electric element 111. The compressor body 113 is elastically supported on the sealed container 101 by a suspension spring 115.

The compression element 109 includes a crankshaft 117, a block 119, a piston 121, a coupling member 123, etc. The crankshaft 117 includes an eccentric shaft 125, a main shaft 127, and an oil feeding mechanism (not shown) which provides communication between the lower end of the main shaft 127 immersed in the refrigerator oil 103 and the upper end of the eccentric shaft 125.

The electric element 111 includes a stator 131 fastened to the lower side of the block 119 by means of a bolt 129, and a rotor 133 disposed coaxially with the stator 131 inward relative to the stator 131 and fastened to the main shaft 127 by shrink fitting. The electric element 111 is inverter-driven with a plurality of operating frequencies.

The block 119 is provided integrally with a cylinder 137 forming a compression chamber 135, and a bearing 139 for supporting the main shaft 127 such that the main shaft 127 is rotatable.

A valve plate 143 having a suction hole 141 and a discharge hole (not shown), a suction valve 145 for opening and closing the suction hole 141, and a cylinder head 147 for closing the valve plate 143 are pressed against the end surface of the cylinder 137 and sealably fastened to the end surface of the cylinder 137 by means of a head bolt 149. In this fastened state, the suction muffler 151 is retained and fastened by the valve plate 143 and the cylinder head 147.

The piston 121 is reciprocatingly inserted into the cylinder 137. The piston 121 and the valve plate 143 define the compression chamber 135. The piston 21 is coupled to the eccentric shaft 125 by means of a coupling member 123.

The suction muffler 151 is molded using fusible synthetic resin such as PBT mainly added with glass fibers. The suction muffler 151 includes an inlet pipe 153 on a side surface thereof of a substantially rectangular shape, and an outlet pipe 155 on an upper surface thereof. The suction muffler 151 forms a muffling space 157 inside thereof. The inlet pipe 153 has a downstream end communicating with the muffling space 157, and an upstream end having an opening portion 159 which opens in the inside of the sealed container 101. The opening portion 159 is positioned to face an opening portion (opening end) of the suction pipe 107 attached on the sealed container 101. In the vicinity of the opening portion 159, there is provided a hood section 160 extending toward the inner wall of the sealed container 101 to collect the cooling medium gas 105 discharged from the suction pipe 107.

The hood section 160 has a circular-arc shape substantially having a large-diameter portion of an oval shape formed by a small-diameter and a large diameter.

To be more specific, the hood section 160 is provided on a side wall 158 having the opening portion 159 in the suction muffler 151. The hood section 160 is provided to extend toward inside of the sealed container 101 such that the hood section 160 protrudes from the side wall 158 in a flow direction of the cooling medium gas 105. The hood section 160 has a circular-arc shape when viewed from the direction in which the hood 160 extends and is disposed to enclose the opening portion 159. The hood section 160 is provided integrally with two first projections 165 of a pin shape on a circular-arc portion (outer peripheral surface) thereof.

The opening portion 159 has a rectangular cross-section which is elongated in upward and downward direction. The opening portion 159 is positioned below the compression chamber 135. The suction muffler 151 is provided such that the opening portion 159 is positioned substantially as high as or lower than the compression chamber 135 provided with a discharge muffler 122. High-pressure cooling medium gas which has been compressed in the compression chamber 135 is discharged to a discharge path (not shown) and then to outside the compressor through the discharge muffler 122 positioned substantially as high as or higher than the compression chamber 135 in a height direction.

Although in the present embodiment, the opening portion 159 has a rectangular shape, it may have a circular shape (including an oval shape) when viewed from the direction in which the hood section 160 extends. Likewise, the cross-section of the inlet pipe 153 which is perpendicular to the direction in which the cooling medium gas flows may have a circular shape or a rectangular shape. The rectangular shape may include a rectangular or square shape having rounded corner portions as well as the rectangular shape or the square shape.

A plate-shaped auxiliary hood 163 made of a flexible material which is a rubber material such as NBR (nitrile butadiene rubber), H-NBR (hydrogenated nitrile butadiene rubber), or FKM (vinylidene fluoride rubber) is fastened to the hood section 160. The auxiliary hood 163 includes a circular-arc portion 163*a* similar to the circular-arc shape of the hood section 160 and a connecting surface 163*b* which is in close contact with the peripheral edge of the opening portion 159 with a certain area and connects both ends of the circular-arc portion 163*a*. The circular-arc portion 163*a* is provided with first through-holes 167 into which the first projections 165 provided on the hood section 160 are inserted, respectively.

The auxiliary hood 163 is fastened to the hood section 160 in such a manner that the tip end portions of the first projections 165 of the hood section 160 are fused (melted) in a state where the first projections 165 are inserted into the first through-holes 167 of the auxiliary hood 163, respectively. To be more specific, the tip end portions of the first projections 165 are fused so as to form flanges having a greater area than an opening area of the first through-holes 167, which prevent the auxiliary hood 163 from being displaced and being disengaged from the hood section 160.

The auxiliary hood 163 has a width set such that the auxiliary hood 163 protrudes to a greater degree than the hood section 160 toward the suction pipe 107 in a width H direction in a state where the auxiliary hood 163 is fastened to the hood section 160 (see FIG. 4). In other words, the auxiliary hood 163 is designed in such a manner that a width of the circular-arc portion 163*a* is set to allow the auxiliary hood 163 to extend toga greater degree than the hood section 160 toward inside of the sealed container 101. Because of this structure, the cooling medium gas can be collected by the inner peripheral surface of the circular-arc portion 163*a* in addition to the inner peripheral surface of the hood section 160. This can increase the area of the gas collected as compared to a structure in which the hood section 160 is provided singly without the auxiliary hood 163.

The auxiliary hood 163 extends toward the suction pipe 107 and is disposed with a little gap X (see FIG. 2) between the auxiliary hood 163 and the inner wall of the sealed container 101 or the suction pipe 107 to prevent the auxiliary hood 163 from contacting them during the operation of the sealed compressor.

Subsequently, the operation and advantages of the sealed compressor configured as described above will be described.

In the sealed compressor, a current is supplied to the stator 131 to generate a magnetic field, and the rotor 133 fastened to the main shaft 127 is rotated, thereby causing the crankshaft 117 to be rotated. The piston 121 reciprocatingly slides inside the cylinder 137 via the coupling member 123 rotatably attached to the eccentric shaft 125. According to the reciprocation movement of the piston 121, the cooling medium gas 105 is suctioned into the compression chamber 135 via the suction muffler 151 and compressed therein. After that, the cooling medium gas 105 is discharged to the discharge path (not shown), and discharged to the refrigeration cycle (not shown) via the discharge muffler 122.

The suction muffler 151 constitutes an expansive muffler defined by the inlet pipe 153, the outlet pipe 155 and the muffling space 157. The suction muffler 151 is configured to mitigate a noise generated by intermittent suction of the cooling medium gas 105.

The suction muffler 151 is made of a resin having a low heat conductivity. This makes it possible to prevent the temperature of the cooling medium gas 105 flowing in the suction muffler 151 from rising due to, for example, heat generated in the electric element 111. Thus, the cooling medium gas 105 with a high density can be suctioned into the compression chamber 135. As a result, a mass flow of the cooling medium gas 105 can be increased and a volume efficiency of the cooling medium gas 105 can be improved.

Subsequently, a suction step of the sealed compressor will be described in greater detail.

When the piston 121 moves in a direction to increase the volume of the cylinder 137, the cooling medium gas 105 in the compression chamber 135 is expanded. When the pressure in the compression chamber 135 becomes lower than a suction pressure, the suction valve 145 opens, due to a difference between the pressure in the compression chamber 135 and the pressure in the suction muffler 151.

The cooling medium gas 105 which returns from the refrigeration cycle has a low temperature. The cooling medium gas 105 is released from the suction pipe 107 into the sealed container 101. Immediately after that, the cooling medium gas 105 is collected into the auxiliary hood 163 and the hood section 160, and is suctioned into the suction muffler 151 through the opening portion 159 provided on the side wall 158 of the suction muffler 151. Then, the cooling medium gas 105 is released into the muffling space 157 through the inlet pipe 153. Then, the cooling medium gas 105 flows into the compression chamber 135 through the outlet pipe 155.

Thereafter, when the piston 121 moves from a bottom dead center in a direction to reduce the volume of the compression chamber 135, the pressure in the compression chamber 135 increases, and the suction valve 145 is closed, due to a difference between the pressure in the compression chamber 135 and the pressure in the suction muffler 151.

In Embodiment 1, the suction muffler 151 is provided with the hood section 160 on the peripheral edge of the opening portion 159, and the hood section 160 is provided with the auxiliary hood 163 made of a flexible material separately from the hood section 160. The auxiliary hood 163 is fastened to the hood section 160 in such a manner that the first projections 165 of the pin shape provided on the hood section 160 are inserted into the first through-holes 167 of the auxiliary hood 163, respectively, and the tip end portions of the first projections 165 are thermally fused and deformed, for example. Such a fastening method can lessen requirements of dimension accuracy of portions by which the auxiliary hood 163 is attached to the hood section 160.

In addition, as shown in FIG. 2, the auxiliary hood 163 extends to a greater degree toward the suction pipe 107 than the hood section 160 and is disposed with a little gap X between the auxiliary hood 163 and the inner wall of the sealed container 101 or the suction pipe 107 to prevent the auxiliary hood 163 from contacting them during the operation of the sealed compressor.

Because of the gap X, a pulsative component of the cooling medium gas 105 in a low frequency range which has not been attenuated sufficiently in the interior of the suction muffler 151 and has been radiated through the opening portion 159 can be released into the sealed container 101 through the gap X, and can be attenuated. As a result, a vibration in pipes in a cooling system can be suppressed and a noise can be reduced. In addition, the opening portion 159 and the suction pipe 107 can be made closer. Because of the collecting action of the auxiliary hood 163 and the hood section 160, in addition to the above layout, a most part of the cooling medium gas 105 released from the suction pipe 107 is not diffused in the interior of the sealed container 101 but can be substantially directly supplied to the interior of the compression chamber 135. Furthermore, because of the gap X, it is possible to lessen the high-temperature cooling medium gas 105 in the interior of the sealed container 101, which is suctioned into the suction muffler 151, to a minimum amount. As a result, high efficiency of the compressor can be achieved and performance of the compressor can be stabilized.

Even if the auxiliary hood 163 contacts (collides) with the inner wall of the sealed container 101, the hood section 160 is less likely to be damaged because the auxiliary hood 163 is made of the flexible material. This, reliability of the sealed compressor can be ensured.

In the case of the inlet pipe 153 having the rectangular cross-section, if the lengthwise direction of the rectangular shape conforms to a vertical direction, then a vertical space of the sealed container 101 can be utilized effectively, in the configuration in which the suction pipe 107 is positioned on the side surface of the sealed container 101 like the present invention.

Since the opening portion 159 of the suction muffler 151 is positioned below the compression chamber 135 such that its upward and downward direction thereof conforms to its lengthwise direction, it possible to prevent a temperature of a region in the vicinity of the inlet pipe 153 from being elevated, and therefore prevent the temperature of the suctioned cooling medium gas from being elevated, because the high-temperature air is radiated from the compression chamber 135 in an upward direction.

Since the opening portion 159 of the suction muffler 151 is positioned as high as or lower in the sealed container 101 than (opposite side of the upper side of) the compression chamber 135 provided with the discharge muffler 112, it is possible to prevent the temperature of the region in the vicinity of the inlet pipe 153 from being elevated, and therefore prevent the temperature of the suctioned cooling medium gas from being elevated, because the high-temperature air is radiated from the discharge muffler 122 in an upward direction.

(Embodiment 2)

Figure 5:
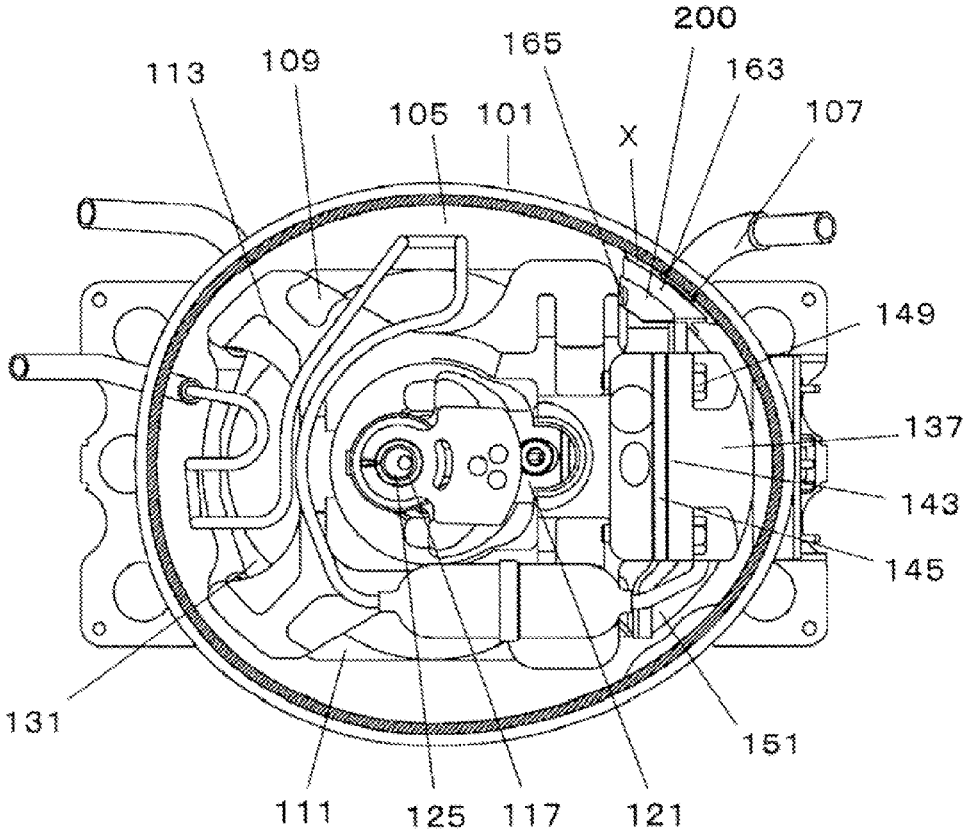
FIG. 5 is a cross-sectional view of a sealed compressor according to Embodiment 2 of the present invention.
Figure 6:
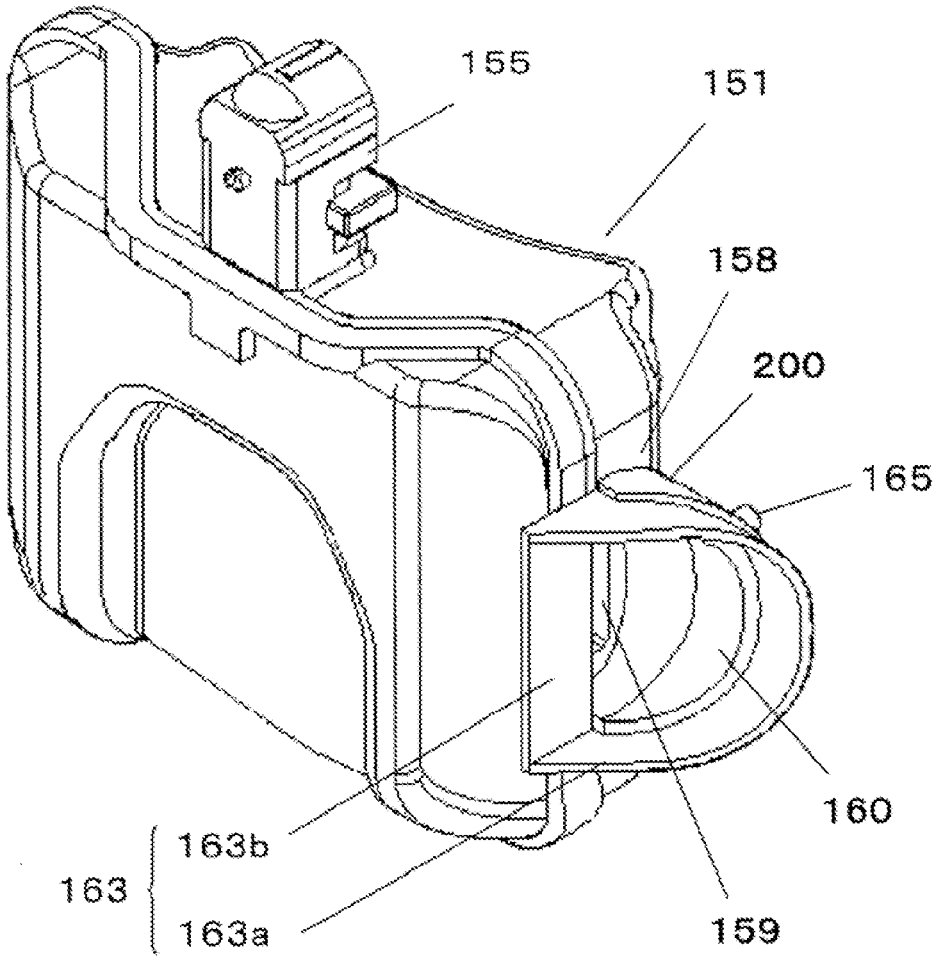
FIG. 6 is a perspective view of a suction muffler of the sealed compressor according to Embodiment 2, when viewed from an outer surface side (sealed container side).
Figure 7:
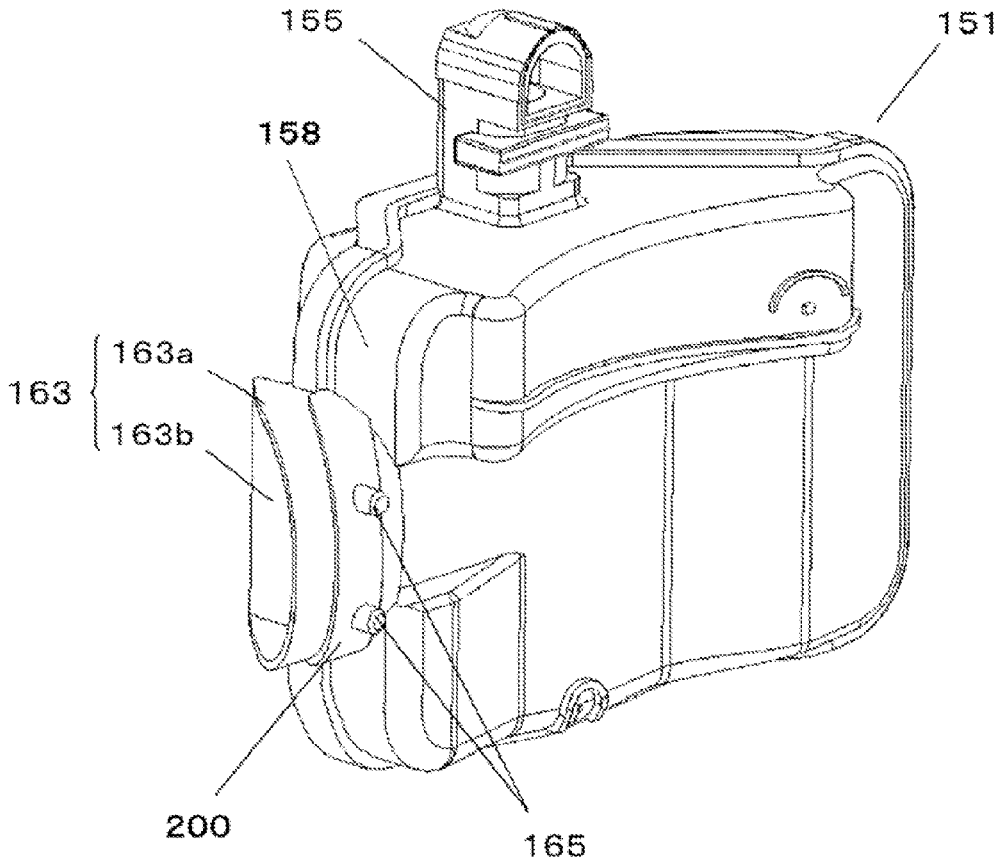
FIG. 7 is a perspective view of the suction muffler of the sealed compressor according to Embodiment 2, when viewed from an inner surface side (electric element side).
Figure 8:
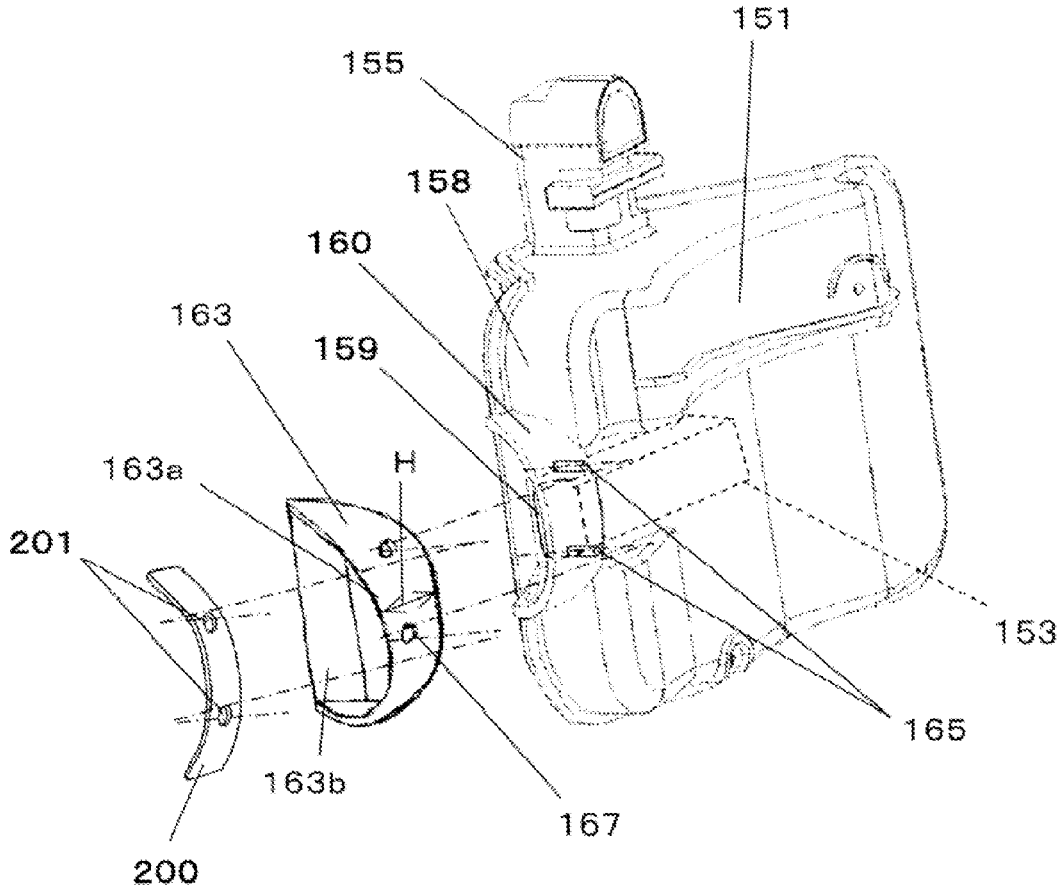
FIG. 8 is an exploded perspective view of the suction muffler of the sealed compressor according to Embodiment 2, when viewed from the inner surface side.

FIG. 5 is a cross-sectional view of a sealed compressor according to Embodiment 2 of the present invention. FIG. 6 is a perspective view of a suction muffler of the sealed compressor according to Embodiment 2, when viewed from an outer surface side (sealed container side). FIG. 7 is a perspective view of the suction muffler of the sealed compressor according to Embodiment 2, when viewed from an inner surface side (electric element side). FIG. 8 is an exploded perspective view of the suction muffler of the sealed compressor according to Embodiment 2, when viewed from the inner surface side. The sealed compressor of Embodiment 2 is identical in configuration to the seated compressor of Embodiment 1 except for a suction muffler. Therefore, in Embodiment 2, the longitudinal sectional view of FIG. 1 is referred to, and the same components as those of Embodiment 1 are identified by the same reference symbols and description of Embodiment 1 is incorporated by reference.

A configuration which is different from that of Embodiment 1 will now be described.

Embodiment 2 is different from Embodiment 1 in a structure for fastening the auxiliary hood 163 in the suction muffler 151.

Referring to FIGS. 5 to 7, the suction muffler 151 is configured in such a manner that the auxiliary hood 163 is fastened to the hood section 160 by a binder 200 for retaining the auxiliary hood 163 with the hood section 160.

The binder 200 has a substantially rectangular shape and has a width smaller than the width of the auxiliary hood 163 and is substantially equal to the width of the hood section 160. The auxiliary hood 163 has a free upstream portion which is not covered with the binder 200 in a state where the auxiliary hood 163 is fastened by the binder 200.

The binder 200 is curved with a curvature substantially equal to that of the hood section 160. The binder 200 has on a main surface thereof through-holes 201 into which the first projections 165 provided on the hood section 160 are inserted, respectively. Although the binder 200 is made of the same synthetic resin as the suction muffler 151 (to be precise, the hood section 160 and the first projections 165), it may be made of metal.

In fastening of auxiliary hood 163 to the hood section 160, the first projections 165 of the hood section 160 are inserted into the first through-holes 167 of the auxiliary hood 163, and are inserted into the through-holes 201 of the binder 200, respectively. Then, in a state where the auxiliary hood 163 is slightly pressed by the binder 200, the tip end portions of the first projections 165 are fused (melted) to have a greater area than the through-holes 201, like Embodiment 1. Thus, fastening of the auxiliary hood 163 to the hood section 160 is completed.

In such a configuration, since the auxiliary hood 163 is pressed by the binder 200 with a certain area, it can be suppressed from being displaced from the hood section 160 in an upward direction.

In the sealed container in which the suction muffler 151 configured as described above is incorporated into the block 119 like Embodiment 1, during the operation of the sealed compressor, when the cooling medium gas released from the suction pipe 107 into the sealed container 101 is collected by the auxiliary hood 163 and the hood section 160, a portion of the auxiliary hood 163 which is in the vicinity of the first projections 165 is prevented from being displaced from the hood section 160 in an upward direction, due to the cooling medium gas discharged. Therefore, the cooling medium gas can be collected effectively.

As a result of the above, the sealed compressor of Embodiment 2 can improve efficiency and stabilize its performance like Embodiment 1.

Since the binder 200 is made of the same synthetic resin as that of the suction muffler 151 (hoot section 160), the binder 200 is fused (melted) when the tip end portions of the first projections 165 are fused. This allows the binder 200 to be integral with the first projections 165. Because of this, a problem that the auxiliary hood 163 will be disengaged from the hood section 160 after a long-time use will not arise. Thus, high reliability of the scaled compressor is achieved.

(Embodiment 3)

Figure 9:
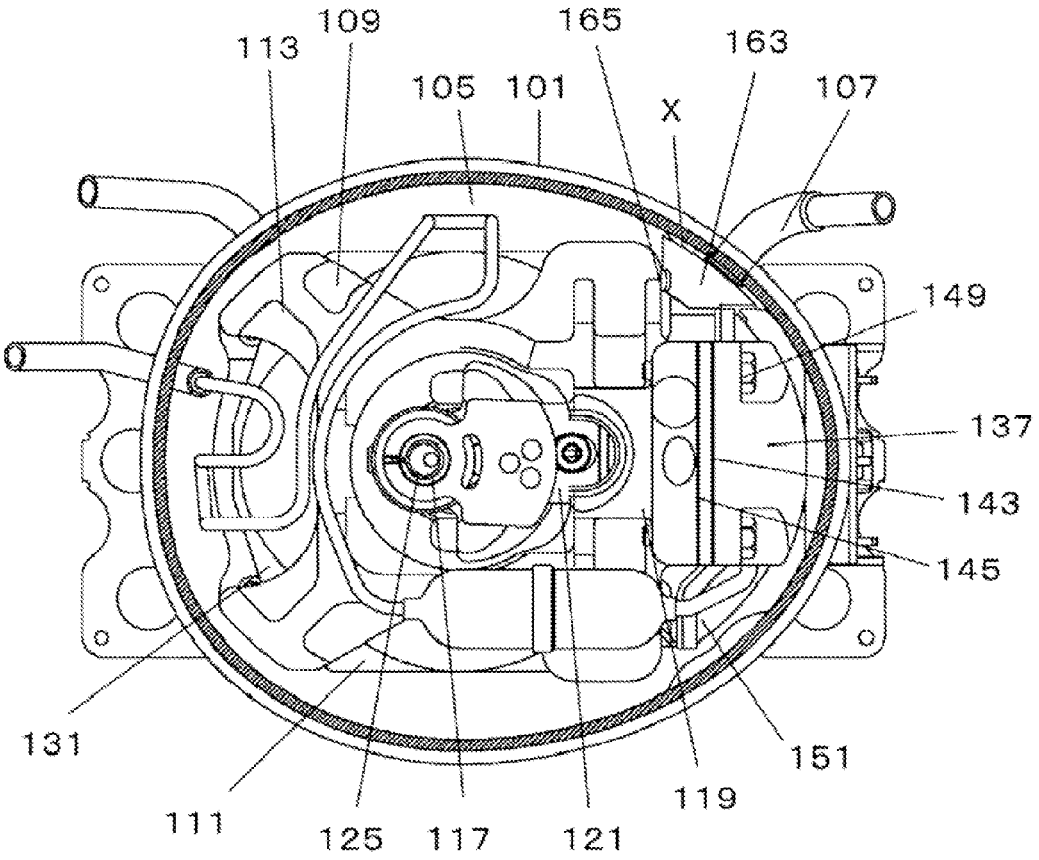
FIG. 9 is a cross-sectional view of a sealed compressor according to Embodiment 3 of the present invention.
Figure 10:
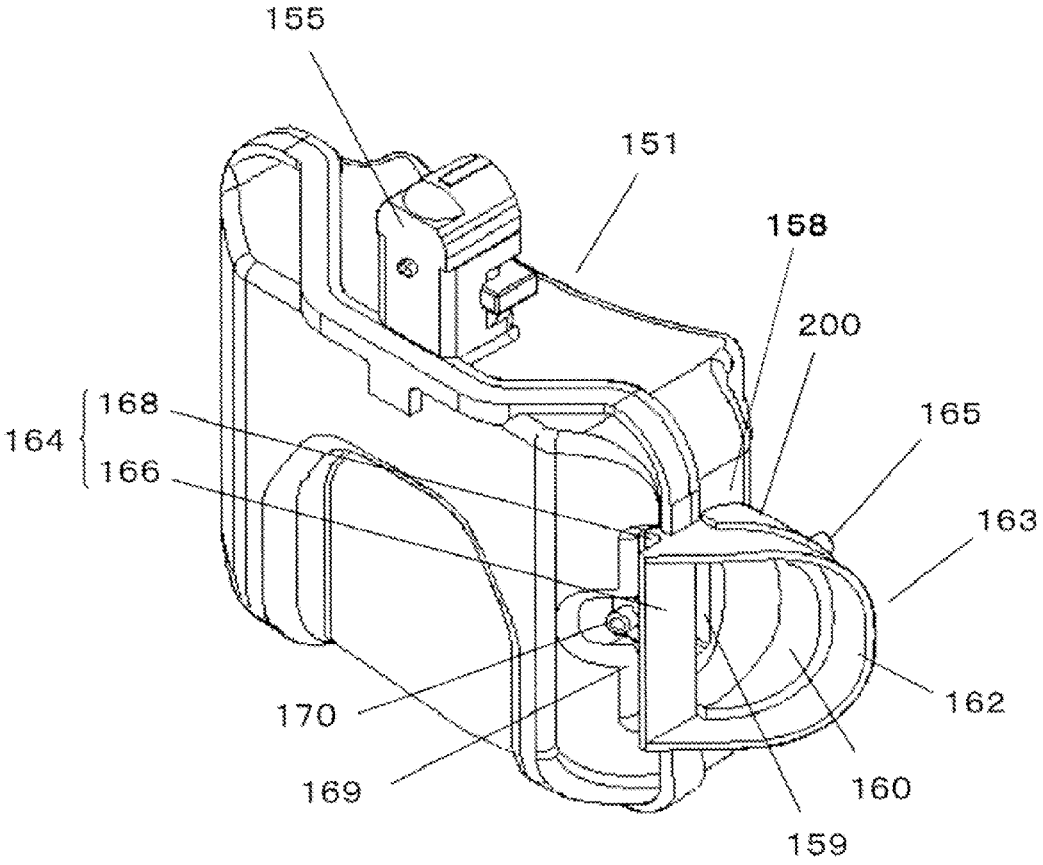
FIG. 10 is a perspective view of a suction muffler of the sealed compressor according to Embodiment 3, when viewed from an outer surface side (scaled container side).
Figure 11:
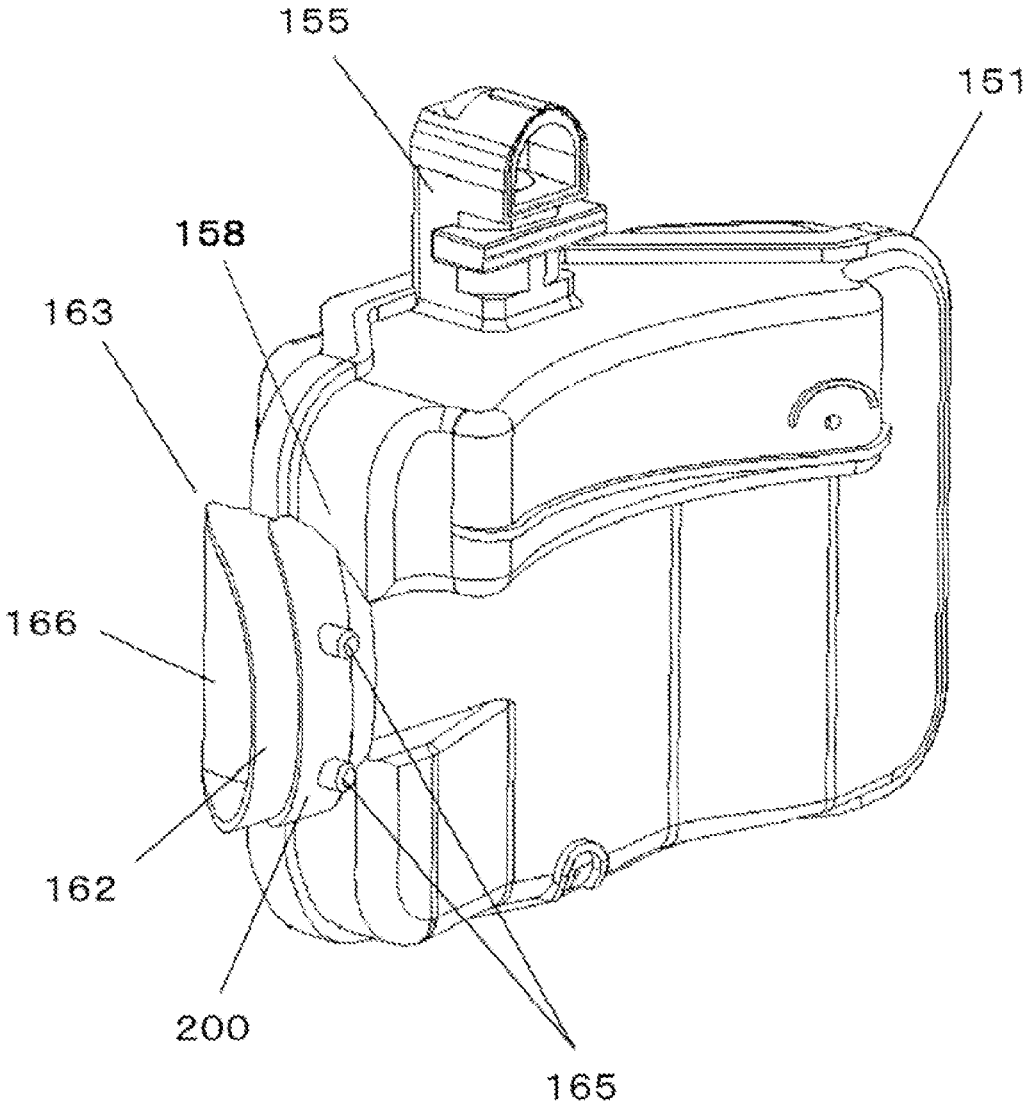
FIG. 11 is a perspective view of the suction muffler of the sealed compressor according to Embodiment 3, when viewed from the inner surface side (electric element side).
Figure 12:
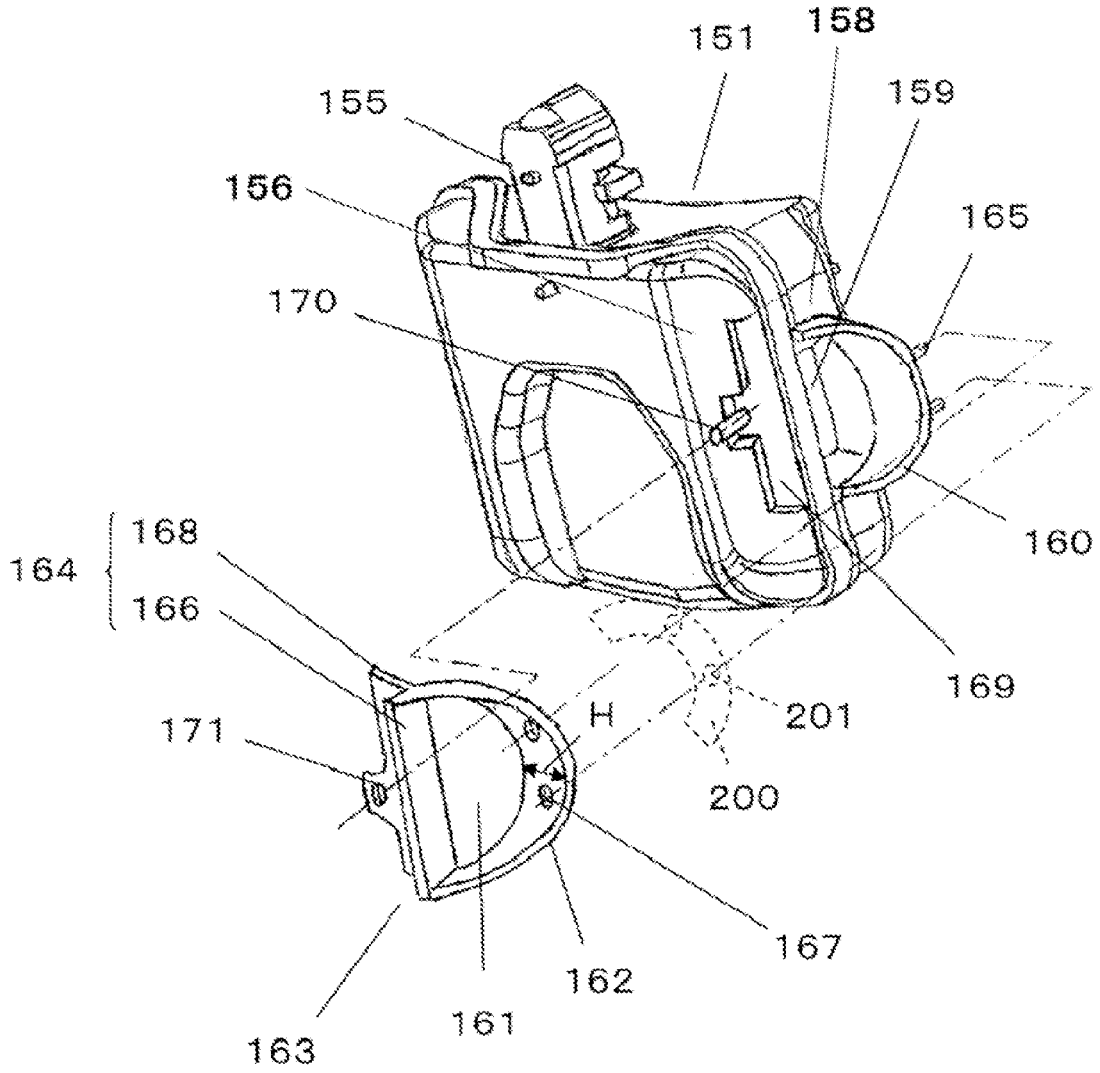
FIG. 12 is an exploded perspective view of major components in the suction muffler of the sealed compressor according to Embodiment 3, when viewed from an inner surface side.

FIG. 9 is a cross-sectional view of a sealed compressor according to Embodiment 3 of the present invention. FIG. 10 is a perspective view of a suction muffler of the sealed compressor according to Embodiment 3, when viewed from an outer surface side (sealed container side). FIG. 11 is a perspective view of the suction muffler of the sealed compressor according to Embodiment 3, when viewed from the inner surface side (electric element side). FIG. 12 is an exploded perspective view of the suction muffler of the sealed compressor according to Embodiment 3, when viewed from an inner surface side.

Referring to FIGS. 9 to 12, the sealed compressor of Embodiment 3 is fundamentally identical in configuration to the sealed compressor of Embodiment 1 except for the suction muffler 151. In Embodiment 3, therefore, the configuration of the suction muffler 151 of the sealed compressor of Embodiment 3 will be described with reference to FIGS. 9 to 12.

The suction muffler 151 has a substantially rectangular parallelepiped (rectangular solid) shape and has the side wall 158 of a substantially rectangular shape having long sides and short sides. The suction muffler 151 is molded mainly using synthetic resin such as PBT added with glass fibers. The suction muffler 151 includes the inlet pipe 153 and the outlet pipe 155 (see FIG. 4) and has the muffling space 157 therein.

The downstream end of the inlet pipe 153 communicates with the muffling space 157 and the upstream end thereof has the opening portion 159 which opens in the interior of the sealed container 101. The opening portion 159 is provided on the side wall 158 of the suction muffler 151 and is positioned to face the suction pipe 107.

The hood section 160 is provided integrally with the peripheral portion of the opening portion 159 to extend toward inside of the sealed container 101. The hood section 160 is configured to collect the cooling medium gas 105 discharged from the suction pipe 107. The hood section 160 has a circular-arc shape forming a large-diameter portion of an oval shape having a small-diameter and a large diameter and is attached on the side wall 158 of the suction muffler 151.

The auxiliary hood 163 made of a flexible material which is a rubber material such as NBR, H-NBR, or FKM is attached to and fastened to the hood section 160.

The auxiliary hood 163 includes a circular-arc portion 162, a connecting portion 166, and a cover portion 168. The circular-arc portion 162 is substantially similar to the hood section 160 and is configured to contact the circular-arc surface of the hood section 160. The connecting portion 166 has a substantially rectangular shape. The connecting portion 166 connects the both ends of the circular-arc portion 162 and is configured to contact the side wall 158 of the suction muffler 151. The cover portion 168 has a substantially rectangular shape and is positioned to protrude from a main surface of the connecting portion 166 which is at an opposite side of a main surface of the connecting portion 166 which is connected to the circular-arc portion 162. The cover portion 168 is configured to contact a front side wall 156 adjacent to the side wall 158 of the suction muffler 151. The connecting portion 166 and the cover portion 168 constitute a press section 164 of the auxiliary hood 163.

The front side wall 156 of the suction muffler 151 with which the cover portion 168 contacts has a recess 169 having a suitable depth to accommodate the cover portion 168 therein. The hood section 160 is provided with the first projections 165 of a pin shape. Likewise, a second projection 170 of a pin shape is provided on the recess 169. The first projection 165 and the second projection 170 protrude in opposite directions.

The circular-arc portion 162 of the auxiliary hood 163 has first through-holes 167 into which the first projections 165 of the hood section 160 are inserted, respectively. Likewise, the cover portion 168 of the auxiliary hood 163 has a second through-hole 171 into which the second projection 170 of the suction muffler 151 is inserted.

The circular-arc portion 162 of the auxiliary hood 163 is configured to contact the hood section 160 in such a manner that the first projection 165 are inserted into the first through-holes 167, respectively, and the inner peripheral surface of the circular-arc portion 162 is made to conform to the outer peripheral surface of the hood section 160 such that an opening portion 161 of the auxiliary hood 163 and the opening portion of the hood section 160 communicate with each other. Note that in this state, the connecting portion 166 is in contact with the side wall 158 of the suction muffler 151, because the connecting portion 166 is configured to contact the side wall 158 when the shape of the auxiliary hood 163 is designed. If the auxiliary hood 163 is designed so that that connecting portion 166 of the auxiliary hood 163 is merely in contact with the side wall 158, there may be a chance that the connecting portion 166 will be separated from the side wall 158 of the suction muffler 151 due to the pressure of the cooling medium gas 105.

As a solution to this, in Embodiment 3, the cover portion 168 of the auxiliary hood 163 has the second through-hole 171 and the suction muffler 151 is provided with the second projection 170. By slightly pulling and deforming the cover portion 168 and inserting the second projection 170 provided on the recess 169 of the suction muffler 151 into the second through-hole 171 of the cover portion 168, a state where the connecting portion 166 is in contact with the side wall 158 of the suction muffler 151 is maintained.

Furthermore, to ensure that the auxiliary hood 163 is fastened to the hood section 160 more surely, the tip end portions of the first projections 165 are fused (melted) by a suitable method to have a greater diameter than the first through-holes 167. As necessary, the plate-shaped binder 200 of Embodiment 2 may be provided to retain the auxiliary hood 163 by the hood section 160 and the binder 200. In this case, the binder 200 is formed to have a shape (circular-arc shape of an oval shape) conforming to the shape of an extended surface of the hood section 160, and has the through-holes 201 into which the first projections 165 of the hood section 160 are inserted, respectively. In a state where the first projections 165 are inserted into the through-holes 201, respectively, the tip end portions of the first projections 165 are fused so that the auxiliary hood 163 is fastened to the hood section 160.

Alternatively, the tip end portion of the second projection 170 inserted into the second through-hole 171 of the cover portion 168 may be fused (melted) so that the cover portion 168 will not be disengaged from the second projection 170.

The auxiliary hood 163 has a width H set such that the auxiliary hood 163 protrudes to a greater degree than the hood section 160 toward the suction pipe 107 in a state where the auxiliary hood 163 is fastened to the hood section 160.

The auxiliary hood 163 extends toward the suction pipe 107 and is disposed with a little gap X (see FIG. 9) between the auxiliary hood 163 and the inner wall of the sealed container 101 or the suction pipe 107 to prevent the auxiliary hood 163 from contacting them during operation of the sealed compressor.

The sealed compressor of Embodiment 3 configured as described above can achieve the same advantages as those of Embodiment 1.

The auxiliary hood 163 is configured such that the connecting portion 166 is in contact with the side wall 158 of the suction muffler 151 and is positioned so as to receive the pressure of the cooling medium gas 105 discharged from the suction pipe 107. Because of this, the contact state between the auxiliary hood 163 and the hood section 160 will be degraded due to swelling, deformation, or the like of the auxiliary hood 163, which would progress over a long-time use, and the connecting portion 166 may be displaced from the suction muffler 151 in an upward direction, due to the pressure of the cooling medium gas 105.

However, in the sealed compressor of Embodiment 3, the second projection 170 provided on the suction muffler 151 is inserted into the second through-hole 171 of the cover portion 168. This makes it possible to prevent the cover portion 168 of the auxiliary hood 163 from being disengaged from the suction muffler 151 and hence the connecting portion 166 of the auxiliary hood 163 from being displaced from the suction muffler 151 in an upward direction.

Since the circular-arc portion 162 of the auxiliary hood 163 is fastened to the hood section 160 by using the first projections 165 inserted into the through-holes 167 and the cover portion 168 of the auxiliary hood 163 is prevented from being disengaged from the suction muffler 151 by using the second projection 170 provided on the recess 169 and inserted into the second through-hole 171, it is possible to prevent the auxiliary hood 163 from being disengaged from the suction muffler 151 during a long-time use. As a result, the auxiliary hood 163 can effectively collect the cooling medium gas 105 stably. Thus, reduction of the efficiency of the sealed compressor can be prevented and reliability of the sealed compressor can be ensured.

Moreover, in the sealed compressor of Embodiment 3, the suction muffler 151 has the recess 169 to accommodate the cover portion 168 of the auxiliary hood 163 and is provided with the second projection 170 of a pin shape on the recess 169. Therefore, a protruding length of the second projection 170 which protrudes from the suction muffler 151 can be reduced, which makes it possible to prevent a contact between the second projection 170 and the inner wall of the container 101, and damage to the suction muffler 151, due to a vibration generated during transportation, start-up, and shut-down of the sealed compressor.

(Embodiment 4)

Figure 13:
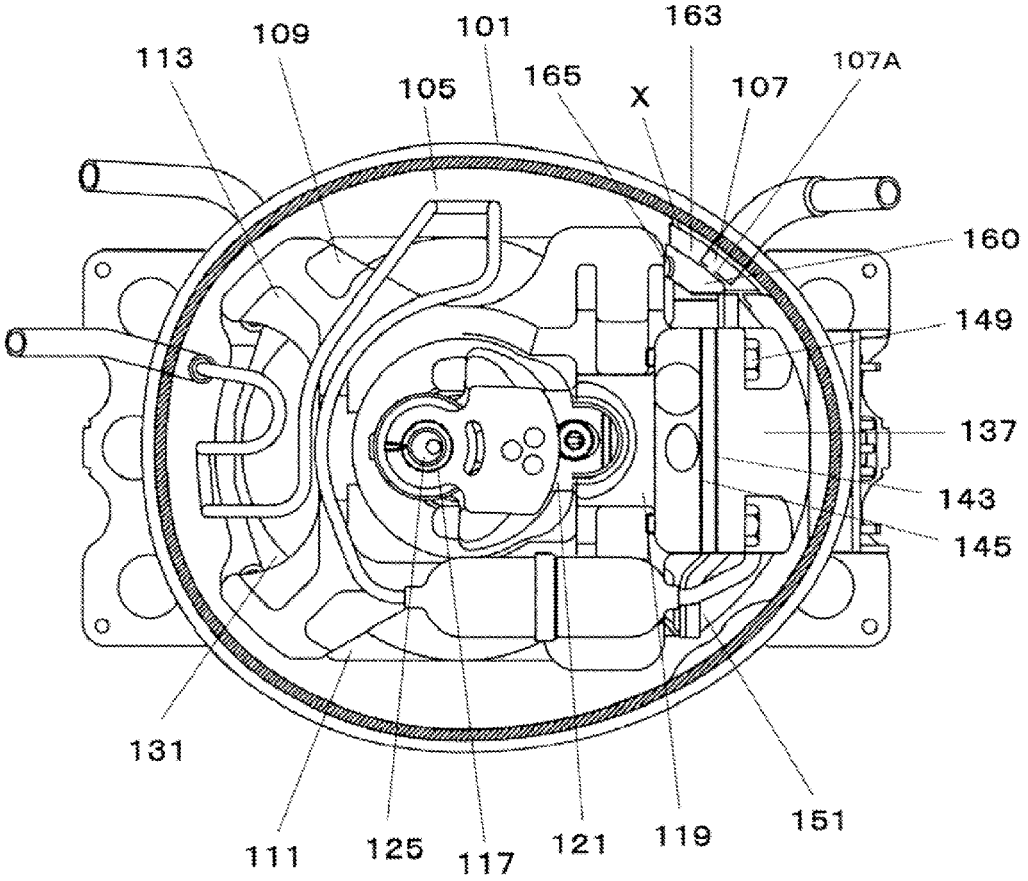
FIG. 13 is a cross-sectional view of a sealed compressor according to Embodiment 4 of the present invention.
Figure 14:
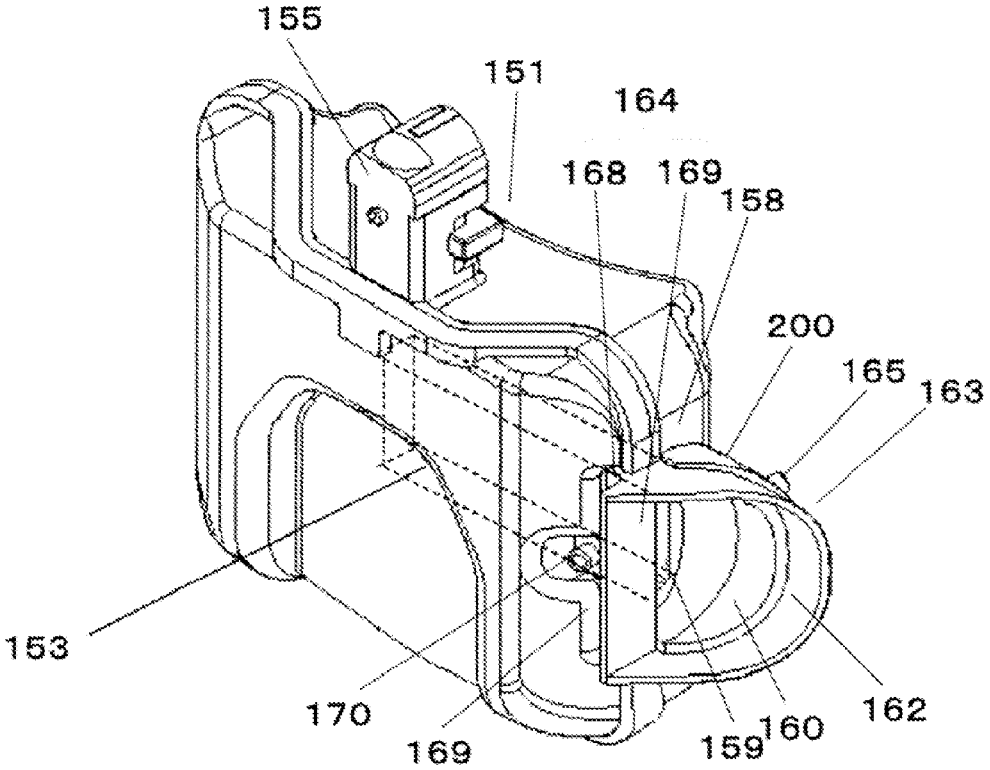
FIG. 14 is a perspective view of a suction muffler of the sealed compressor according to Embodiment 4.

FIG. 13 is a cross-sectional view of a sealed compressor according to Embodiment 4 of the present invention. FIG. 14 is a perspective view of a suction muffler of the sealed compressor according to Embodiment 4.

The sealed compressor of Embodiment 4 of the present invention is fundamentally identical in configuration to the sealed compressor of Embodiment 3 except for the suction pipe 107 and the suction muffler 151. Hereinafter, the configuration of the suction muffler 151 of the sealed compressor of Embodiment 4 will be described with reference to FIGS. 13 and 14.

Referring to FIG. 13, in the sealed compressor of Embodiment 4, the suction pipe 107 extends into inside of the sealed container 101 to a greater degree than the suction pipe 107 (see FIG. 9) of the sealed compressor of Embodiment 3. More specifically, the suction pipe 107 is configured such that an opening 107A of the suction pipe 107 at the sealed container 101 side is positioned between the base end portion of the hood section 160 and the tip end portion of the auxiliary hood 163 in the suction muffler 151. Preferably, the suction pipe 107 is configured such that the opening 107A at the sealed container 101 side is positioned between the base end portion of the hood section 160 and the base end portion of the auxiliary hood 163 in the suction muffler 151.

Referring to FIG. 14, the hood section 160 and the auxiliary hood 163 have circular-arc cross-sections in a direction perpendicular to the direction in which the hood section 160 and the auxiliary hood 163 extend such that the cross-sections are geometrically similar to each other. The inner peripheral surface of the hood section 160 is connected smoothly to the inlet pipe 153 through the opening portion 159.

The phrase "inner peripheral surface of the hood section 160 is connected smoothly to the inlet pipe 153 through the opening portion 159" means that the cross-sectional area of the inner peripheral surface of the hood section 160 is greater in a portion at the auxiliary hood 163 side and is smaller in a portion connected to the inlet pipe 153, and the hood section 160 has a shape in which its cross-sectional area decreases gradually without a substantial stepped portion or the like.

A portion of the hood section 160 which is in the vicinity of the portion connected to the inlet pipe 153 has a cross-section formed by a continuous curved surface. In other words, the cross-section of the portion of the hood section 160 which is in the vicinity of the portion connected to the inlet pipe 153 is formed by a continuous curved line without a straight-line portion to provide smooth connection.

Preferably, the cross-sectional area of the portion of the hood section 160 which is connected to the inlet pipe 153 is substantially equal to, or slightly greater than the cross-sectional area of the inlet pipe 153 at the inlet side (For example, the cross-sectional area of the portion of the hood section 160 which is connected to the inlet pipe 153 is about 100% to 120% of the cross-sectional area of the inlet pipe 153 at the inlet side).

The sealed compressor of Embodiment 4 configured as described above can achieve the same advantages as those of Embodiment 3.

In addition, in the sealed compressor of Embodiment 4, the opening 107A of the suction pipe 107 at the sealed container 101 side is positioned between the base end portion of the hood section 160 and the tip end portion of the auxiliary hood 163 in the suction muffler 151. Because of this, a most part of the cooling medium gas 105 released from the suction pipe 107 is not diffused in the interior of the sealed container 101 but can be supplied to a space within the opening portion 159 of the suction muffler 151, and hence to the interior of the compression chamber 135. This makes it possible to lessen the high-temperature cooling medium gas 105 in the interior of the sealed container 101, which is suctioned into the suction muffler 151, to a minimum amount. Furthermore, since the opening 107A of the suction pipe 107 at the sealed container 101 side is positioned in close proximity to the opening 107A of the suction pipe 107 which is a lowest-temperature portion within the sealed container 101, a temperature increase in the cooling medium gas 105 can be lessened to a minimum level.

Furthermore, in the sealed compressor of Embodiment 4, the hood section 160 and the auxiliary hood 163 have cross-sectional shapes which are geometrically similar to each other. Because of this, the hood section 160 and the auxiliary hood 163 can be made in close contact with each other. This makes it possible to more effectively prevent the auxiliary hood 163 from being disengaged from the hood section 160 and the auxiliary hood 163 from being displaced from the hood section 160 in an upward direction. If the auxiliary hood 163 is displaced in an upward direction, suction of the cooling medium gas 105 into the opening portion 159 will be precluded. In the sealed compressor of Embodiment 4, it is possible to more effectively suppress that the suction of the cooling medium gas 105 into the opening portion 159 is precluded. Therefore, reliability of the sealed compressor can be improved. Also, the flow of the cooling medium gas 105 from the auxiliary hood 163 to the hood section 160 can be guided into the suction muffler 151 more efficiently without being obstructed due to a rapid shape change.

Moreover, in the scaled compressor of Embodiment 4, the hood section 160 has the cross-sectional area which decreases gradually (smoothly). Such a shape does not preclude the flow of the cooling medium gas 105 in the interior of the hood section 160, and allows the cooling medium gas 105 to be guided into the suction muffler 151 more efficiently.

As should be appreciated, the shape of the inlet pipe 153 located in the interior of the suction muffler 151 is not limited by the shape of the hood section 160 and the shape of the auxiliary hood 163. Therefore, an optimal shape of the inlet pipe 153 may be selected to achieve a highest suction efficiency of the cooling medium gas 105 and a highest muffling effect. As a result, the efficiency of the sealed compressor can be improved, and its performance can be stabilized.

(Embodiment 5)

Figure 15:
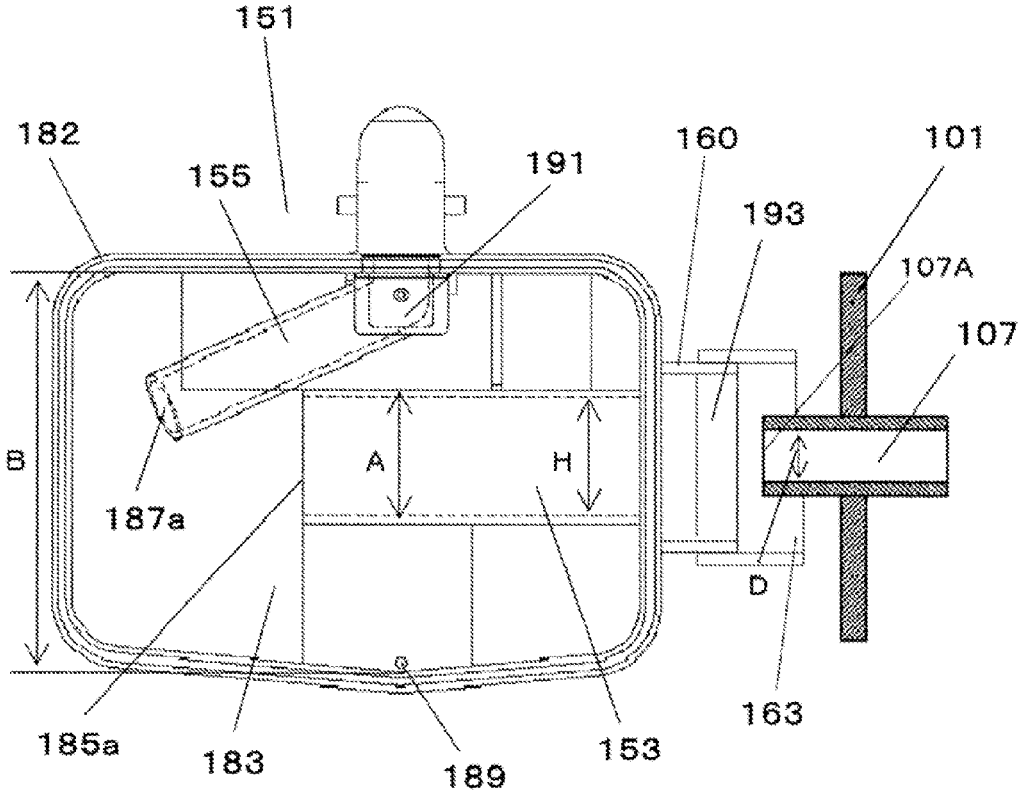
FIG. 15 is an enlarged cross-sectional view of major components in a sealed compressor according to Embodiment 5 of the present invention.
Figure 16:
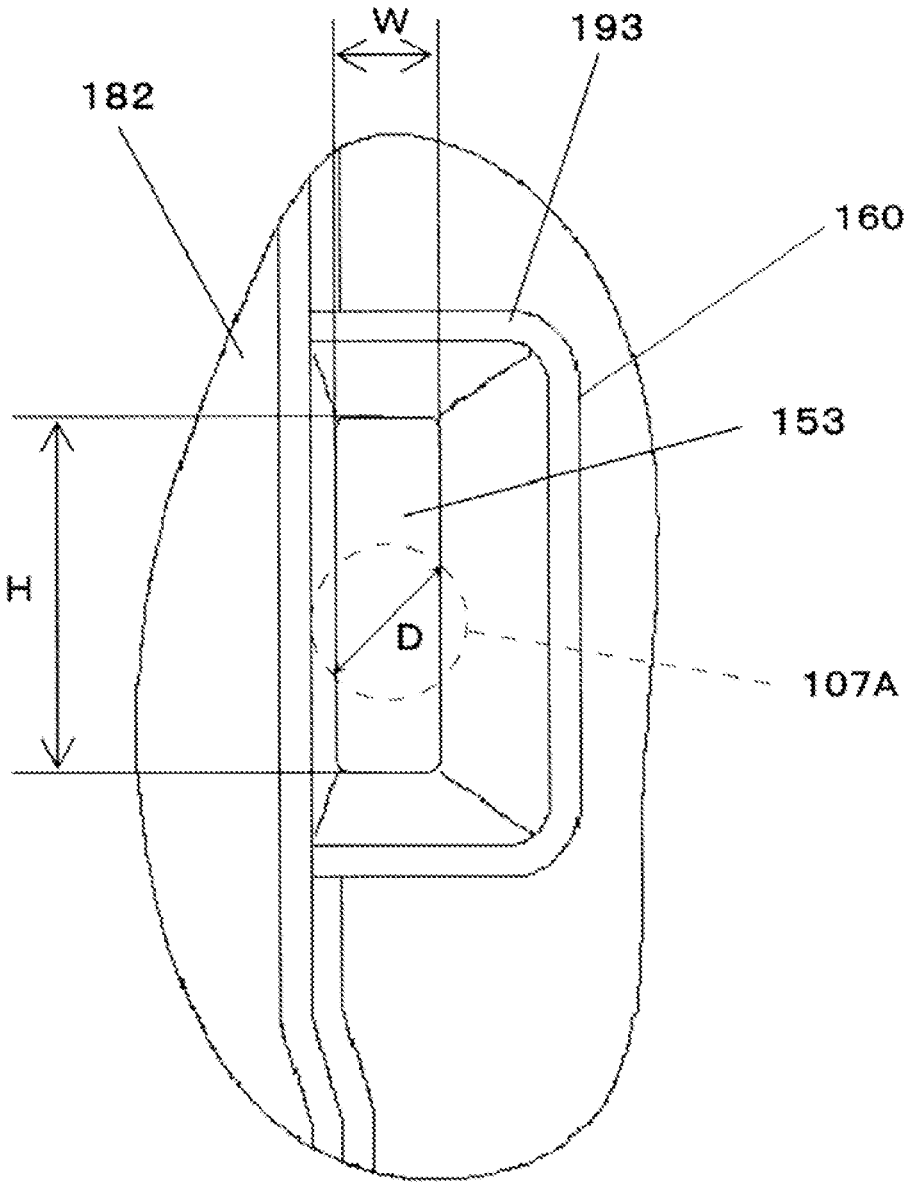
FIG. 16 is an enlarged view of major components of a suction muffler according to Embodiment 5.
Figure 17:
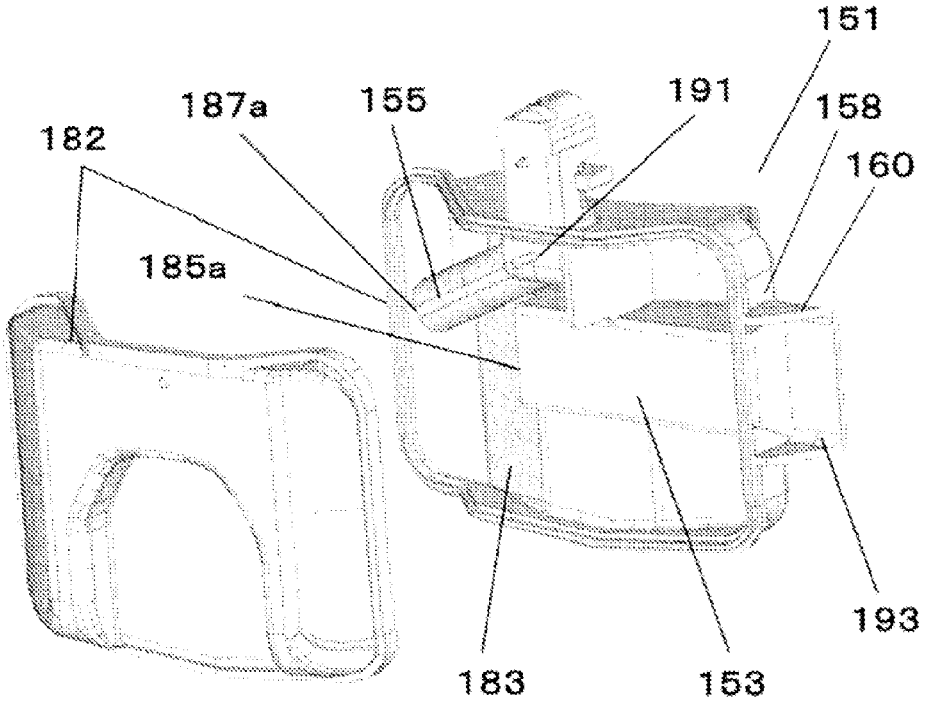
FIG. 17 is an exploded perspective view of the suction muffler according to Embodiment 5.
Figure 18:
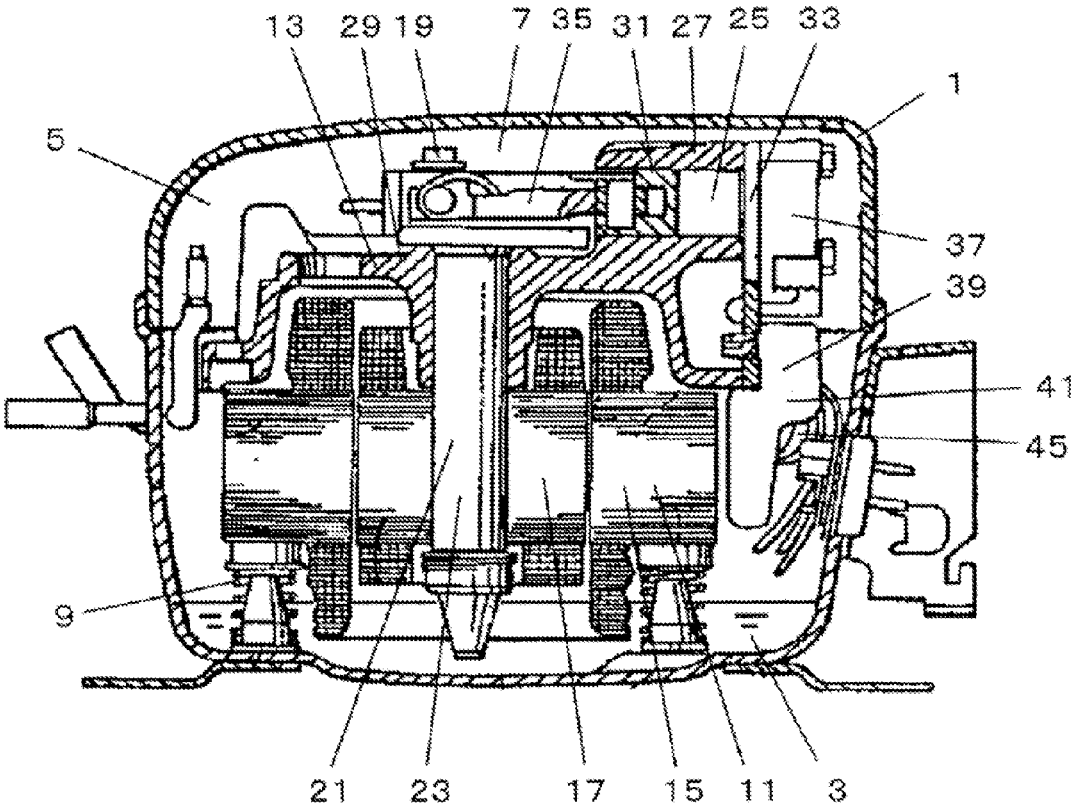
FIG. 18 is a longitudinal sectional view of a conventional sealed compressor disclosed in Japanese Unexamined Patent Application Publication No. Sho. 63-500878.
Figure 19:
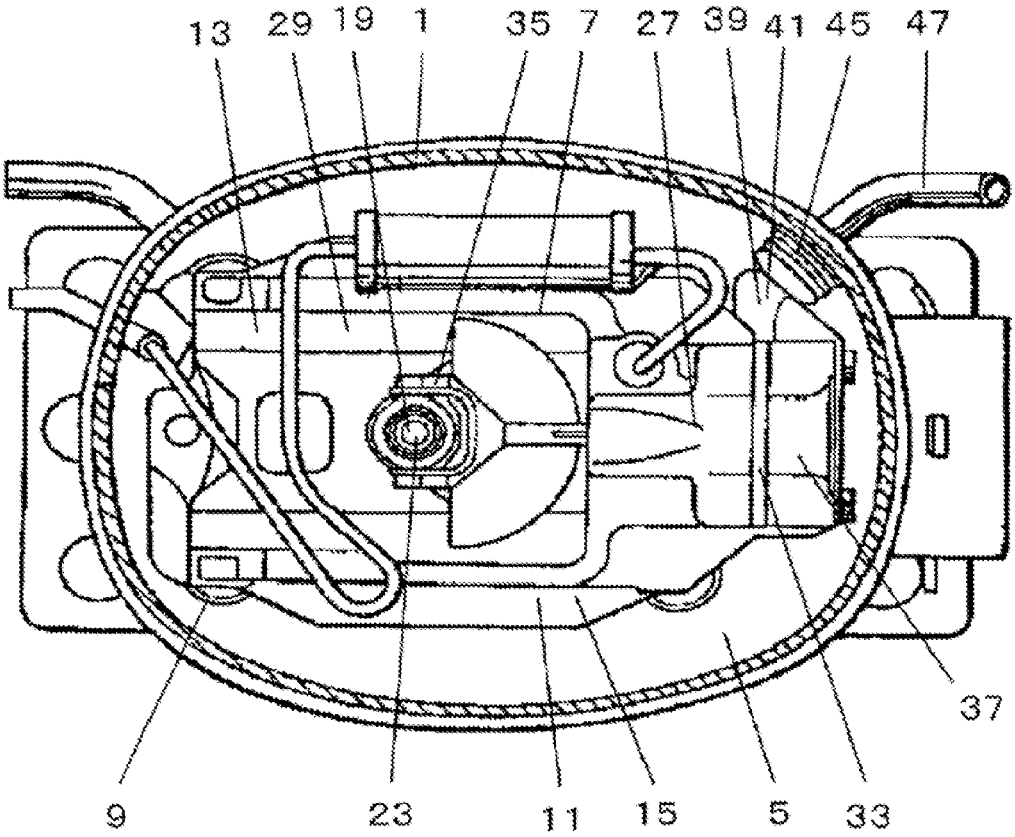
FIG. 19 is a cross-sectional view of the sealed compressor of FIG. 18.
Figure 20:
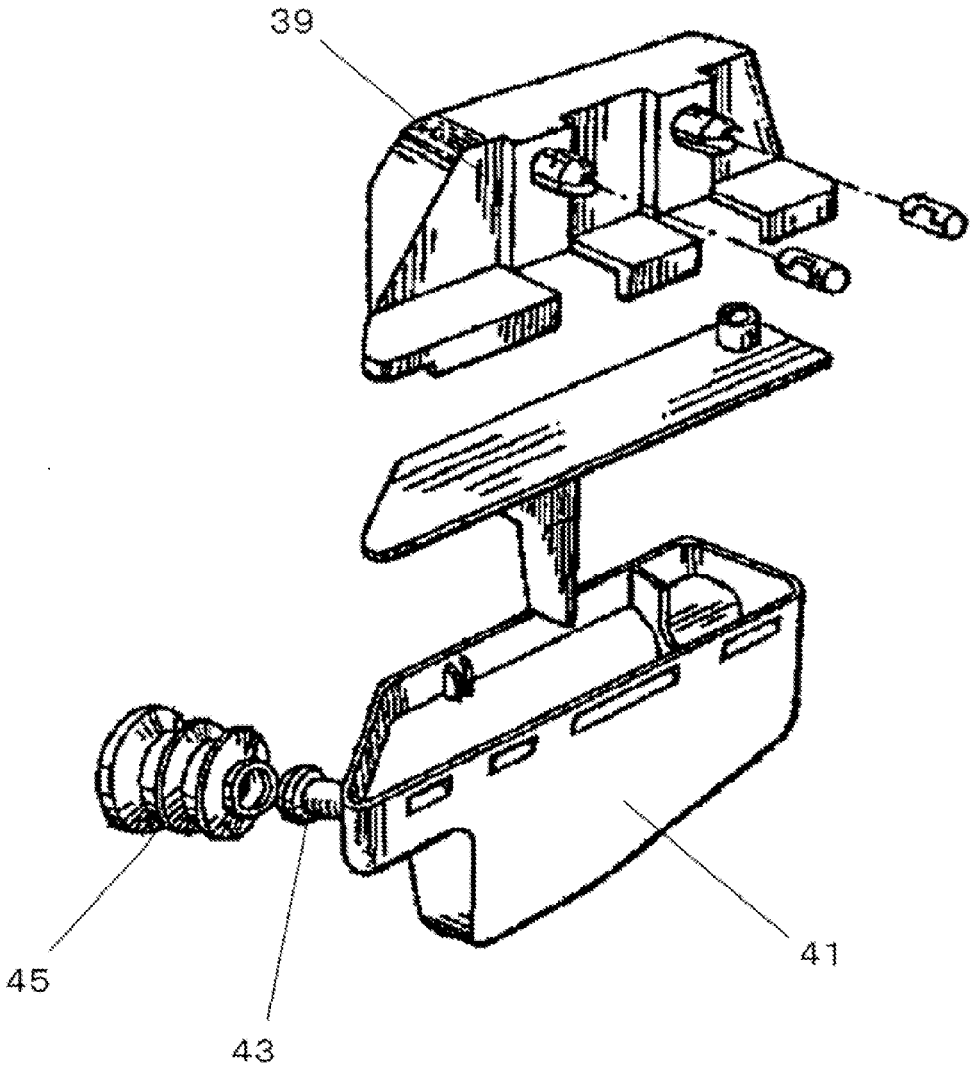
FIG. 20 is an enlarged view of major components of the sealed compressor of FIG. 18.
Figure 21:
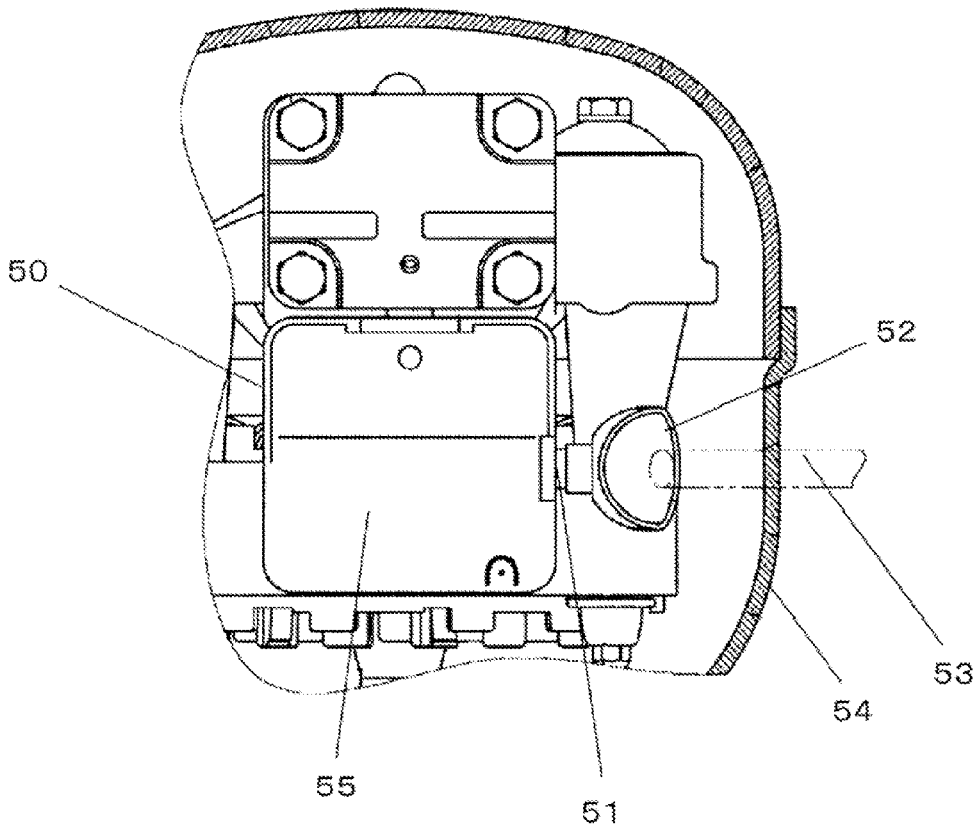
FIG. 21 is an enlarged view of major components of another conventional sealed compressor disclosed in Japanese Laid-Open Patent Application Publication No. 2010-084677.

FIG. 15 is an enlarged cross-sectional view of major components in a sealed compressor according to Embodiment 5 of the present invention. FIG. 16 is an enlarged view of major components of a suction muffler according to Embodiment 5. FIG. 17 is an exploded perspective view of the suction muffler according to Embodiment 5. In FIGS. 16 and 17, the auxiliary hood is omitted.

Referring to FIGS. 15 to 17, the sealed compressor of Embodiment 5 of the present invention is fundamentally identical in configuration to the sealed compressor of Embodiment 1 except for the suction muffler 151. Hereinafter, the configuration of the suction muffler 151 of the sealed compressor of Embodiment 5 will be described with reference to FIGS. 15 to 17.

The suction muffler 151 includes the body 182 forming a muffling space 183, the inlet pipe 153, the outlet pipe 155 and an oil discharge hole 189 provided in a lower portion of the muffling space 183. The suction muffler 151 is molded using PBT (polybuthylene terephthalate). The inlet pipe 153 is molded integrally with the body 182.

The outlet pipe 155 provides communication between the muffling space 183 and the compression chamber 135 via the valve plate 143 (see FIGS. 1 and 2). The outlet pipe 155 has a bent portion 191 bent such that it is inclined in a downward direction, in an intermediate portion between an opening portion leading to the muffling space 183 and an opening portion of the valve plate 143. To be specific, the outlet pipe 155 penetrates a portion of the upper wall portion of the body 182, and the bent portion 191 is provided immediately under this portion of the upper wall portion. A portion of the outlet pipe 155 which is upstream of the bent portion 191 extends to be inclined in a downward direction relative to a horizontal direction.

As shown in FIGS. 15 and 17, an opening end 187*a* of the outlet pipe 155 opens in the same direction as the direction in which an opening end 185*a* of the inlet pipe 153 at the muffling space 183 side opens. The opening end 187*a* of the outlet pipe 155 has a portion overlapping with the opening end 185*a* of the inlet pipe 153 when viewed from the direction in which the inlet pipe 153 extends. The area of the portion of the opening end 187*a* which overlaps with the opening end 185*a* may be set as desired.

The inlet pipe 153 provides communication between the muffling space 183 and the inner space of the sealed container 101. The inlet pipe 153 has a linear shape, i.e., straight-line pipe shape having no bent portion, in the flow direction of the cooling medium gas 105. The opening portion of the inlet pipe 153 at the sealed container 101 side forms the opening portion 159 of the suction muffler 151 at the sealed container 101 side and faces the opening 107A of the suction pipe 107 at the sealed container 101 side.

The cross-section of a cooling medium passage of the inlet pipe 153 (cross-section perpendicular to the direction in which the cooling medium gas 105 flows) has a substantially rectangular shape having corner portions with a circular-arc shape. A vertical (maximum) length H of the opening portion of the inlet pipe 153 at the sealed container 101 side is set greater than a vertical (maximum) length (inner diameter of the suction pipe 107) D of the opening 107A of the suction pipe 107 at the sealed container 101 side (see FIG. 15). A horizontal (maximum) length W of the opening portion of the inlet pipe 153 at the sealed container 101 side is set smaller than the vertical (maximum) length D of the opening 107A of the suction pipe 107 at the sealed container 101 side (see FIGS. 15 and 16).

In Embodiment 5, the vertical length H of the opening portion of the inlet pipe 153 at the sealed container 101 side is 12 mm, the horizontal length W of the opening portion of the inlet pipe 153 at the sealed container 101 side is 6 mm, and the diameter D of the opening 107A of the suction pipe 107 at the sealed container 101 side is 9 mm.

In Embodiment 5, a vertical (maximum) length A of the inlet pipe 153 is 25~50% of a vertical (maximum) length B of the muffling space 183.

In Embodiment 5, the vertical length A of the inlet pipe 153 is 14 mm, the vertical maximum length B of the muffling space 183 is 50 mm, and a percentage of the vertical length A of the inlet pipe 153 with respect to the vertical maximum length B of the muffling space 183 is about 28%.

As shown in FIG. 16, a U-shaped wall portion 193 is formed to enclose the opening portion of the inlet pipe 153 at the sealed container 101 side from three directions. The inner wall of a lower wall portion of the U-shaped wall portion 193 is positioned below the lower end of the opening 107A of the suction pipe 107 at the sealed container 101 side. The wall portion 193 constitutes the hood section 160.

Subsequently, the operation and advantages of the sealed compressor configured as described above will be described.

In the sealed compressor, the stator 131 is supplied with a current from an outside power supply to generate a magnetic field, and thereby the crankshaft 117 is rotated. According to the rotation, the piston 121 reciprocatingly slides inside the compression chamber 135. According to the reciprocation of the piston 121, the compression element 109 performs a predetermined compression operation (see FIGS. 1 and 2).

According to this operation, the cooling medium gas flowing from a cooling system (not shown) is released into the sealed container 101 once through the suction pipe 107. Then, the cooling medium gas is suctioned into the suction muffler 151 through the inlet pipe 153 and is released into the muffling space 183. Then, the cooling medium gas is suctioned into the compression chamber 135 through the outlet pipe 155 and the valve plate 143.

In the compression chamber 135, the cooling medium gas is compressed by the reciprocation movement of the piston 121, and then is discharged into the cooling system (not shown) again.

During a state in which the compressor is shut down for a sufficiently long time, the cooling medium gas staying in the sealed container 101 has a temperature substantially equal to a temperature outside the sealed container 101. Upon the compression element 109 starting a predetermined compressive operation, the cooling medium gas staying in the sealed container 101 receives heat generated in the compression element 109 and raises its temperature.

By comparison, the cooling medium gas flowing from the cooling system (not shown) has a relatively low temperature. Because of this, the cooling medium gas flowing into the scaled container 101 from the suction pipe 107 has a lower temperature and a higher specific gravity than the cooling medium gas staying in the sealed container 101. The cooling medium gas staying in the sealed container 101 is affected by the rotation of the crankshaft 117, and therefore flows in the same direction as the direction in which the crankshaft 117 rotates.

Because of the above, the cooling medium gas flowing into the sealed container 101 from the suction pipe 107 tends to flow downward in the rotational direction of the crankshaft 117.

As a solution to the above, in Embodiment 5, the U-shaped wall portion 193 is formed to enclose the opening portion of the inlet pipe 153 at the sealed container 101 side from three directions, to obstruct the flow of the cooling medium gas in the vicinity of the opening 107A of the suction pipe 107 at the sealed container 101 side, thereby lessening the flow of the cooling medium gas 105 flowing in the rotational direction of the crankshaft 117.

The inner wall of the lower wall portion of the wall portion 193 is positioned below the lower end of the opening 107A of the suction pipe 107 at the sealed container 101 side, and receives the cooling medium gas having a relatively low temperature, which is flowing downward due to a difference in the specific gravity. The wall portion 193 allows the cooling medium gas having a relatively low temperature to stay efficiently in the vicinity of the opening portion of the inlet pipe 153 at the sealed container 101 side. Therefore, it is possible to selectively supply the cooling medium gas having a relatively low temperature to the interior of the suction muffler 151. As a result, a suction mass (cooling medium circulation amount) of the cooling medium gas per unit time can be increased, and hence efficiency of the sealed compressor can be improved.

The cooling medium gas is flowing into the muffling space 183 through the inlet pipe 153 under the influence of a friction with the inner wall of the inlet pipe 153. A flow passage resistance in the inlet pipe 153 can be reduced by increasing a passage cross-sectional area of the inlet pipe 153 in which the cooling medium gas flows.

However, in the interior of the suction muffler 151, a pressure pulsation or a noise is generated, due to the flow of the cooling medium gas in the inlet pipe 153. In addition, in the interior of the compression chamber 135, a pressure pulsation occurs due to the suction and compression operation of the cooling medium gas, or a sliding noise is generated due to the reciprocation movement of the piston 121. The noise and pulsation propagate in a direction opposite to the flow of the cooling medium gas, through the outlet pipe 155, the muffling space 183 and then the inlet pipe 153, are released into the sealed container 101, and are radiated from the sealed container 101 as a noise.

For the above reason, if the passage area of the inlet pipe 153 is increased, a noise in the sealed compressor may possibly increase undesirably.

Therefore, to reduce a pressure pulsation and a noise which cannot be attenuated sufficiently due to the increase in the passage cross-sectional area of the inlet pipe 153, it is necessary to increase an attenuation amount of it in the outlet pipe 155 and the muffling space 183.

In one approach, the size of the muffling space 183 may be possibly increased. However, if the passage cross-sectional area of the inlet pipe 153 is increased without changing the size of the body 182 of the suction muffler 151, the muffling space 183 is inevitably reduced, because a portion of the inlet pipe 153 which opens in the muffling space 183 is located in the interior of the suction muffler 151. Therefore, this approach is undesirable.

To increase the volume of the muffling space 183, it is necessary to increase the size of the body 182 of the suction muffler 151. However, typically, the suction muffler 151 is made of, for example, a resin having a low heat conductivity to prevent heat generated in the stator 131 and the like from being received by the cooling medium gas staying in the suction muffler 151. When the suction muffler 151 collides with the inner wall of the sealed container 101 during transportation of the sealed compressor, etc., it may be bent or cracked. Even if the suction muffler 151 is made of a stiff material such as metal, it may generate a big noise when it collides with the inner wall of the sealed container 101 during transportation of the sealed compressor, etc.

As should be appreciated, it is necessary to lay out the suction muffler 151 such that a sufficient distance is provided between the suction muffler 151 and the inner wall of the sealed container 101 to prevent the suction muffler 151 from contacting the inner wall of the sealed container 101. There is a limitation in an increase in the size of the body 182 of the suction muffler 151 in a limited space.

In Embodiment 5, the suction muffler 151 is made of PBT which is a resin, and is sized to provide a sufficient distance between the muffler 151 and the inner wall of the scaled container 101. In addition, the vertical length A of the inlet pipe 153 is set to 25~50% of the vertical length B of the muffling space 183.

Since the vertical length A of the inlet pipe 153 is set to 25~50% of the vertical length B of the muffling space 183 which occupies a greater part of the volume of the suction muffler 151, a space volume is ensured so that resistance in the cooling medium gas passage of the inlet pipe 153 is suppressed and the pressure pulsation and the noise in the muffling space 183 can be sufficiently attenuated.

In Embodiment 5, the cooling medium gas passage of the inlet pipe 153 has a linear (straight-line) shape having no bent portion to achieve a reduction of the resistance of the cooling medium gas in the flow passage of the inlet pipe 153. In the case of the suction muffler 151 made of a resin, it is typically manufactured by injection molding using a die. In this case, if the inlet pipe 153 is bent, the die has an intricate shape undesirably.

Since the inlet pipe 153 has a linear (straight-line) shape, it is easily molded integrally with the body 182 of the suction muffler 151, and the die used for manufacturing the suction muffler 151 can be formed easily. Furthermore, since the inlet pipe 153 is molded integrally with the body 182 of the suction muffler 151, at least one wall surface of the inlet pipe 153 and the wall surface of the suction muffler 151 are a common wall surface. This can suppress a reduction in the volume of the muffling space 183.

In a case where the efficiency of the sealed compressor is adjusted, the number of steel plates stacked together to construct the stator 131 is changed in some case. In this case, the inlet pipe 153 and the opening 107A of the suction pipe 107 at the sealed container 101 side are positioned closer to each other such that they face each other, and the cooling medium gas flow passage cross-sectional area of the inlet pipe 153 is increased such that the vertical length H of the opening portion of the inlet pipe 153 at the sealed container 101 side is set greater than the vertical length D of the opening 107A of the suction pipe 107 at the sealed container 101 side. In this way, the positional relationship between the inlet pipe 153 and the opening portion of the suction pipe 107 which faces the inlet pipe 153 is maintained, even in the case where the suction muffler 151 is incorporated into the sealed compressor including the stator 131 which is different in the number of steel plates.

In Embodiment 5, the vertical length H of the opening portion of the inlet pipe 153 at the sealed container 101 side is 12 mm, and the vertical length D of the opening 107A of the suction pipe 107 at the sealed container 101 side is 9 mm, and they are laid out such that their vertical centers conform to each other.

In Embodiment 5, if the number of steel plates of the stator 131 is changed, the inlet pipe 153 and the suction pipe 107 are configured to face each other and a relationship between the opening portion of the flow passage of the inlet pipe 153 and the opening portion of the flow passage of the suction pipe 107 which face each other is unchanged (i.e., the opening 107A of the suction pipe 107 is located within a projecting area of the opening portion of the inlet pipe 153), so long as an increase/decrease in the dimension of the number of steel plates of the stator 131 is within a range of 1.5 mm.

Even when the number of steel plates of the stator 131 is different, the suction muffler 151 and the sealed container 101 can be used as common components. Thus, complexity of component management is obviated while maintaining the efficiency, and a reduction of productivity and an increase in manufacturing cost can be suppressed.

Commonly, in the interior of the sealed container 101, a space in which the suction muffler 151 is disposed has a shape in which its horizontal length is smaller than its vertical length. Therefore, if the cooling medium gas flow passage cross-section of the inlet pipe 153 is increased in a horizontal direction, the size of the muffling space 183 may be reduced, and the muffling space 183 may be divided in a vertical direction.

Typically, the pressure pulsation and the noise propagating from the outlet pipe 155 is expanded and thereby attenuated by releasing them into the muffling space 183. If the muffling space 183 is divided, the pressure pulsation and the noise propagating from the outlet pipe 155 cannot be attenuated effectively. In Embodiment 5, to prevent the muffling space 183 from being divided while ensuring they flow passage cross-sectional area, the horizontal length W of the opening portion of the inlet pipe 153 at the sealed container 101 side is set smaller than the vertical maximum length D of the opening 107A of the suction pipe 107 at the sealed container 101 side, and vertical length of the opening portion of the inlet pipe 153 at the sealed container 101 side is set greater than the vertical maximum length D of the opening 107A of the suction pipe 107 at the sealed container 101 side. In this way, the noise can be reduced while maintaining high efficiency.

Since the cross-section of the inlet pipe 153 has a substantially rectangular shape, the vertical dimension can be ensured more easily and the cross-sectional area can be increased more easily, than the cross-section of the inlet pipe 153 having a square shape, a circular shape, an oval shape, etc. In a case where the position of the opening portion of the inlet pipe 153 at the sealing container 101 side is differed in the vertical direction, like a case where the suction muffler 151 is incorporated into the sealed compressor in which the number of steel plates of the stator 131 is different, it is possible to increase a length (range) for ensuring the positional relationship between the inlet pipe 153 and the opening portion of the suction pipe 107 which faces the inlet pipe 153.

By ensuring the overall length of the outlet pipe 135, the noise of the sealed compressor can be reduced. If the overall length of the outlet pipe 155 which opens in the muffling space 183 of the suction muffler 151 is increased in a linear shape, then the size of the body 182 of the suction muffler 151 increases. If the volume of the muffling space 183 is increased to reduce the pressure pulsation and the noise which cannot be attenuated, which results from a decrease in the overall length of the outlet pipe 155, then the size of the body 182 of the suction muffler 151 increases.

In Embodiment 5, since the outlet pipe 155 has the bent portion 191 inclined in the downward direction, it can have a sufficient length without reducing its overall length. Therefore, the outlet pipe 155 can attenuate the pressure pulsation and the noise.

The oil feeding mechanism 121 transports the refrigerator oil 103 from the bottom portion of the sealed container 101 to the compression element positioned thereabove, by utilizing a centrifugal force or the like generated by the rotation of the crankshaft 117. The transported refrigerator oil 103 lubricates the crankshaft 117 and a slidable portion such as the bearing 139. After that, the refrigerator oil 103 is scattered from the upper end of the crankshaft 117 into the sealed container 101, to lubricate the piston 121 and other component. The scattered refrigerator oil 103 adheres onto the inner wall surface of the sealed container 101, moves along the inner wall surface of the sealed container 101, and drops to the bottom portion of the sealed container 101. During this time, heat is transferred from the refrigerator oil 103 to the sealed container 101 and is radiated from the sealed container 101 to outside, thereby cooling the sealed compressor.

The refrigerator oil 103 which has not adhered onto the inner wall surface of the sealed container 101 but has been scattered is suctioned from the inlet pipe 153 into the suction muffler 151, together with the cooling medium gas. When the cooling medium gas is released from the inlet pipe 153 into the muffling space 183 and its velocity is reduced, a most part of the refrigerator oil 103 is separated from the cooling medium gas. The separated refrigerator oil 103 stays in the bottom portion of the body 182 of the suction muffler 151 and is discharged through the oil discharge hole 189 to outside the suction muffler 151.

The refrigerator oil 103 which has not dropped but has been scattered in the muffling space 183, adheres onto the inner wall surface of the muffling space 183 and the outer surface of the outlet pipe 155. By the flow of the cooling medium gas inflowing from the inlet pipe 153, the refrigerator oil 103 moves toward the opening end 187*a* of the outlet pipe 155, and a part of the refrigerator oil 103 changes into oil droplets which are suctioned from the outlet pipe 155 during the movement. In Embodiment 5, since the outlet pipe 155 is inclined in the downward direction, it is possible to suppress a liquid with a high specific gravity such as a large quantity of the refrigerator oil 103 or a liquid cooling medium, from flowing into the compression chamber 135.

Since the opening end 187*a* of the outlet pipe 155 at the muffling space 182 side opens in the same direction as the direction in which the opening end 185*a* of the inlet pipe 153 opens, and a part of the opening end 187*a* is positioned on an extended line of the projecting area of the opening end 185*a* of the inlet pipe 153, the refrigerator oil 103 collides against the wall surface of the outlet pipe 155 together with the cooling medium gas. However, since the outlet pipe 155 is inclined in the downward direction, the refrigerator oil 103 adhering onto the wall surface of the outlet pipe 155 moves along the wall surface of the outlet pipe 155 and drops from the lower end of the outlet pipe 155. Therefore, it is possible to suppress the refrigerator oil 103 from flowing into the outlet pipe 155.

In a portion of the muffling space 183, in the vicinity of the opening end 187*a* of the outlet pipe 155, a relatively low-temperature state is formed, because the cooling medium gas with a relatively low temperature is supplied intermittently from the inlet pipe 153. In addition, since a part of the opening end 187*a* of the outlet pipe 155 at the muffling space 183 side is positioned on the extended line of the projecting area of the opening end 185*a* of the inlet pipe 153, the cooling medium gas having a relatively low temperature which is discharged from the opening end 185*a* of the inlet pipe 153 can be suctioned easily into the outlet pipe 155. This makes it possible to guide the cooling medium gas having a relatively low temperature to the compression chamber 135, which results in a higher compression efficiency.

Since the outlet pipe 155 and the inlet pipe 153 are laid out in such a manner that the opening end 187*a* of the outlet pipe 155 at the muffling space 183 side and the opening end 185*a* of the inlet pipe 153 at the muffling space 183 side do not face each other, the pressure pulsation generated by the compression operation, the sliding noise generated by the reciprocation movement of the piston 121, and others propagate to the inlet pipe 153 through the muffling space 183, in a state where the pulsation and the noise are attenuated through the muffling space 183, even when they propagate in the direction opposite to the flow of the cooling medium gas. In this way, the noise radiated from the sealed container 101 can be reduced.

As described above, the sealed compressor of the present invention can stabilize performance of a cooling system and improve efficiency. Therefore, the sealed compressor is widely incorporated into air conditioners, automatic vending machines, and other refrigerators, in addition to electric refrigerator-freezer for household use.

Numeral modifications and alternative embodiments of the present invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention.

What is claimed is:

1. A sealed compressor comprising:

an electric element;

a compression element driven by the electric element;

a sealed container accommodating the electric element and the compression element; and a suction pipe attached on the sealed container to provide communication between inside and outside of the sealed container;

wherein the compression element includes a compression chamber, a piston provided inside of the compression chamber, and a suction muffler made of a fusible resin material, the suction muffler communicating with the inside of the sealed container and the compression chamber;

the suction muffler is laid out such that an opening portion thereof at the sealed container side faces an opening portion of the suction pipe at the sealed container side; and the suction muffler includes a hood section provided in the vicinity of the opening portion of the suction muffler to extend toward the inside of the sealed container, the hood section being configured to collect cooling medium gas discharged from the suction pipe; and an auxiliary hood fastened to the hood section and extending toward an inner surface of the sealed container so as to increase an area of the hood section for collecting the cooling medium gas, with a gap maintained between the auxiliary hood and the inner surface of the sealed container, and a gap maintained between the suction pipe and an opening portion of the auxiliary hood at the suction pipe side, so as to prevent the auxiliary hood from contacting the inner surface of the sealed container during operation, the auxiliary hood being made of a flexible rubber material.

2. The sealed compressor according to claim 1, wherein the hood section is provided with a first projection of a pin shape;

the auxiliary hood has a first through-hole; and the hood section and the auxiliary hood are fastened together in a state where the first projection is inserted into the first through-hole and a tip end portion of the first projection is deformed.

3. The sealed compressor according to claim 1, wherein the suction muffler has a rectangular side wall having long sides and short sides, and the side wall has the opening portion; and the hood section is provided on the side wall and has a circular-arc shape when viewed from a direction in which the hood section extends.

4. The sealed compressor according to claim 2, further comprising: a binder having a through-hole; wherein the hood section, the auxiliary hood, and the binder are joined together in this order; and the hood section, the auxiliary hood, and the binder are fastened together in a state where the first projection is inserted into the first through-hole of the auxiliary hood and into the through-hole of the binder, and the tip end portion of the first projection is deformed.

5. The sealed compressor according to claim 4, wherein the binder and the first projection of the hood section are made of the same material.

6. The sealed compressor according to claim 1, wherein the auxiliary hood has a press section for receiving a pressure of the cooling medium gas discharged from the suction pipe.

7. The sealed compressor according to claim 6, wherein the auxiliary hood has a circular-arc portion having a circular-arc shape; the press section includes a connecting portion connecting both ends of the circular-arc portions together, at least a portion of the connecting portion being configured to contact a side wall of the suction muffler; and a cover portion provided on the connecting portion and configured to contact a front side wall adjacent to the side wall of the suction muffler.

8. The sealed compressor according to claim 7, further comprising:

a second projection of a pin shape provided on the front side wall of the suction muffler which contacts the cover portion of the auxiliary hood;

wherein the cover portion of the auxiliary hood has a second through-hole into which the second projection is fitted.

9. The sealed compressor according to claim 8, wherein the front side wall of the suction muffler which contacts the cover portion of the auxiliary hood has a recess to accommodate the cover portion.

10. The sealed compressor according to claim 1, wherein the opening of the suction pipe at the sealed container side is positioned between a base end portion of the hood section and a tip end portion of the auxiliary hood in the suction muffler.

11. The sealed compressor according to claim 1, wherein a cross-section of the hood section in a direction perpendicular to a direction in which the hood section extends is geometrically similar to a cross-section of the auxiliary hood in a direction perpendicular to a direction in which the auxiliary hood extends.

12. The sealed compressor according to claim 1, wherein the suction muffler includes:

a body forming a muffling space;

an inlet pipe having an upstream end forming the opening portion of the suction muffler at the sealed container side and a downstream end which opens in the muffling space;

an outlet pipe having a downstream end communicating with the compression chamber, an upstream end which opens in the muffling space; and a bent portion between the upstream end and the downstream end in the muffling space, a portion of the outlet pipe which is upstream of the bent portion being inclined in a downward direction; and an oil discharge hole provided in a bottom portion of the muffling space so as to open in a space inside of the sealed container;

wherein the inlet pipe has a shape in which a horizontal length of an opening of the upstream end is smaller than a horizontal length of the opening of the suction pipe, and a vertical length of the opening of the upstream end is greater than a vertical length of the opening of the suction pipe.

13. The sealed compressor according to claim 12, wherein the inlet pipe has a shape in which a vertical length of the inlet pipe is set to 25 to 50% of a vertical length of the muffling space.

14. The sealed compressor according to claim 12, wherein the inlet pipe is molded integrally with the body; and the inlet pipe has a flow passage having a linear shape having no bent portion.

15. The sealed compressor according to claim 12, wherein a cross-section of the inlet pipe in a direction perpendicular to a direction in which the cooling medium gas flows has a substantially rectangular shape.

16. The sealed compressor according to claim 1, wherein the hood section of the suction muffler is formed of wall portions on at least three sides including a lower wall portion at a lower side of the opening portion of the suction muffler at the sealed container side when viewed from the direction in which the hood section extends, the wall portions enclosing the opening portion; and the lower wall portion is positioned below a lower end of the opening portion the suction pipe at the sealed container side.

17. The sealed compressor according to claim 12, wherein an opposite end of the outlet pipe opens in the same direction as a direction in which an opposite end of the inlet pipe opens.

18. The sealed compressor according to claim 13, wherein the hood section has an inner peripheral surface connected smoothly to the inlet pipe through the opening portion of the suction muffler at the sealed container side.

* * * * *